US009472199B2

(12) United States Patent
Lee et al.

(10) Patent No.: US 9,472,199 B2
(45) Date of Patent: Oct. 18, 2016

(54) VOICE SIGNAL ENCODING METHOD, VOICE SIGNAL DECODING METHOD, AND APPARATUS USING SAME

(71) Applicant: LG Electronics Inc., Seoul (KR)

(72) Inventors: Younghan Lee, Seoul (KR); Gyuhyeok Jeong, Seoul (KR); Ingyu Kang, Seoul (KR); Hyejeong Jeon, Seoul (KR); Lagyoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/347,767

(22) PCT Filed: Sep. 28, 2012

(86) PCT No.: PCT/KR2012/007889

§ 371 (c)(1),
(2) Date: Mar. 27, 2014

(87) PCT Pub. No.: WO2013/048171

PCT Pub. Date: Apr. 4, 2013

(65) Prior Publication Data

US 2014/0236581 A1 Aug. 21, 2014

Related U.S. Application Data

(60) Provisional application No. 61/540,518, filed on Sep. 28, 2011, provisional application No. 61/684,826, filed on Aug. 20, 2012.

(51) Int. Cl.
*G10L 19/00* (2013.01)
*G10L 19/02* (2013.01)
(Continued)

(52) U.S. Cl.
CPC ..... *G10L 19/02* (2013.01); *G10L 19/032* (2013.01); *G10L 19/0212* (2013.01); *G10L 19/24* (2013.01)

(58) Field of Classification Search
None
See application file for complete search history.

(56) References Cited

U.S. PATENT DOCUMENTS 4,885,790 A * 12/1989 McAulay ..... G10L 19/02 704/261
5,684,926 A * 11/1997 Huang ..... G10L 19/16 704/208

(Continued)

FOREIGN PATENT DOCUMENTS

EP 2120234 A4 8/2011
EP 2525357 A4 11/2014

(Continued)

OTHER PUBLICATIONS

Imai, Satoshi, and Chieko Furuichi. "Impulse train equivalent excitation signals for high-quality speech synthesis." Electronics and Communications in Japan (Part I: Communications) 70.3 (1987): 41-53.*

(Continued)

*Primary Examiner* — Pierre-Louis Desir
*Assistant Examiner* — Jonathan Kim
(74) *Attorney, Agent, or Firm* — Fish & Richardson P.C.

(57) ABSTRACT

The present invention relates to a method and apparatus for processing a voice signal, and the voice signal encoding method according to the present invention comprises the steps of: generating transform coefficients of sine wave components forming an input voice signal by transforming the sine wave components; determining transform coefficients to be encoded from the generated transform coefficients; and transmitting indication information indicating the determined transform coefficients, wherein the indication information may include position information, magnitude information, and sign information of the transform coefficients.

14 Claims, 11 Drawing Sheets

(51) Int. Cl.
*G10L 19/032* (2013.01)
*G10L 19/24* (2013.01)

(56) References Cited

U.S. PATENT DOCUMENTS

| | | | | |
|---|---|---|---|---|
| 5,924,064 | A | 7/1999 | Helf | |
| 6,502,068 | B1 * | 12/2002 | Misu | G10L 19/10 704/216 |
| 6,539,349 | B1 * | 3/2003 | Benno | G10L 19/10 704/219 |
| 6,728,669 | B1 * | 4/2004 | Benno | G10L 19/10 704/219 |
| 7,050,970 | B2 | 5/2006 | Den | |
| 7,058,571 | B2 | 6/2006 | Tsushima | |
| RE40,691 | E * | 3/2009 | Lim | 704/206 |
| 7,739,106 | B2 | 6/2010 | Oomen | |
| 8,271,270 | B2 * | 9/2012 | Lee | G10L 19/09 704/203 |
| 2001/0053972 | A1 * | 12/2001 | Amada | G10L 19/10 704/220 |
| 2002/0007268 | A1 | 1/2002 | Oomen | |
| 2002/0156621 | A1 | 10/2002 | Den | |
| 2005/0065785 | A1 * | 3/2005 | Bessette | G10L 19/10 704/211 |
| 2005/0080621 | A1 | 4/2005 | Tsushima | |
| 2006/0009967 | A1 | 1/2006 | Gerrits | |
| 2006/0074639 | A1 * | 4/2006 | Goudar | G10L 19/09 704/207 |
| 2006/0206319 | A1 * | 9/2006 | Taleb | G10L 19/10 704/223 |
| 2007/0094009 | A1 * | 4/2007 | Ryu | G10L 19/005 704/200.1 |
| 2007/0124138 | A1 * | 5/2007 | Lamblin | G10L 19/12 704/212 |
| 2007/0156395 | A1 * | 7/2007 | Ojala | G10L 19/06 704/211 |
| 2008/0154586 | A1 | 6/2008 | Gao | |
| 2009/0180531 | A1 * | 7/2009 | Wein | G10L 19/08 375/240 |
| 2009/0210219 | A1 | 8/2009 | Sung et al. | |
| 2011/0213614 | A1 * | 9/2011 | Lu | G10L 15/02 704/236 |
| 2013/0060365 | A1 * | 3/2013 | Jeong | G10L 19/20 700/94 |

FOREIGN PATENT DOCUMENTS

| | | | |
|---|---|---|---|
| JP | 2005-520217 | A | 7/2005 |
| JP | 2008040452 | A | 2/2008 |
| JP | 2010521712 | T | 6/2010 |
| KR | 10-2002-0027557 | A | 4/2002 |
| KR | 10-2002-0084206 | A | 11/2002 |
| WO | WO 01/99097 | A1 | 12/2001 |
| WO | WO 02/056299 | A1 | 7/2002 |
| WO | WO 2004/013841 | A1 | 2/2004 |
| WO | WO2008114932 | A1 | 9/2008 |
| WO | WO2009055493 | A1 | 4/2009 |
| WO | 2010093224 | | 8/2010 |
| WO | WO2010134757 | A3 | 3/2011 |
| WO | WO2011087332 | A3 | 12/2011 |

OTHER PUBLICATIONS

Jong-Hark, Kim., Gyu-Hyeok Jeong, and Lee. In-Sung. "Analysis-by-synthesis sinusoidal model without an overlapping scheme." IEICE transactions on communications 91.6 (2008): 2094-2096.*

Laaksonen, Lasse, et al. "Superwideband Extension of G. 718 and G. 729.1 Speech Codecs." Eleventh Annual Conference of the International Speech Communication Association. 2010.*

Lee et al. "Super-Wideband Bandwidth Extension Using Normalized MDCT Coefficients for Scalable Speech and Audio Coding" (2010).*

McAulay, Robert J., and T. F. Quatieri. Sinusoidal Coding. No. MS-11427. Massachusetts Inst of Tech Lexington Lincoln Lab, 1995.*

George, E. Bryan, and Mark JT Smith. "Speech analysis/synthesis and modification using an analysis-by-synthesis/overlap-add sinusoidal model."Speech and Audio Processing, IEEE Transactions on 5.5 (1997): 389-406.*

Jeong, GyuHyeok et al. Embedded bandwidth scalable wideband codec using hybrid matching pursuit harmonic/CELP scheme, Published online May 16, 2010.*

Quatieri, Thomas F., and Robert J. McAulay. "Audio signal processing based on sinusoidal analysis/synthesis." Applications of digital signal processing to audio and acoustics. Springer US, 2002. 343-416.*

International Search Report dated Feb. 25, 2013 for Application No. PCT /KR2012/007889, with English Translation, 6 pages.

Tammi et al., "Scalable Superwideband Extension for Wideband Coding", Acoustics, Speech and Signal Processing, ICASSP 2009, IEEE International Conference 2009, pp. 161-164, Apr. 19, 2009.

Search Report dated Apr. 7, 2015 from corresponding European Patent Application No. 12836122.7, 8 pages.

Office Action issued in Chinese Application No. 201280057514.X on Aug. 4, 2015, 16 pages.

Zhu, "Audio Subsystem Design and Audio Signal Processing Algorithm Research for Digital Television," Doctoral Dissertation, Apr. 2009, 11 pages.

* cited by examiner

VOICE SIGNAL ENCODING METHOD, VOICE SIGNAL DECODING METHOD, AND APPARATUS USING SAME

CROSS REFERENCE TO RELATED APPLICATIONS

This application is a U.S. National Phase Application under 35 U.S.C. §371 of International Application PCT/KR2012/007889, filed on Sep. 28, 2012, which claims the benefit of U.S. Provisional Application No. 61/540,518, filed on Sep. 28, 2011, and U.S. Provisional Application No. 61/684,826, filed on Aug. 20, 2012, the entire content of the prior applications in hereby incorporated by reference init entirety.

TECHNICAL FIELD

The present invention relates to encoding and decoding of a voice signal, and more particularly, to methods of encoding and decoding a sinusoidal voice signal and an apparatus using the methods.

BACKGROUND ART

In general, audio signals include signals of various frequencies, the human audible frequency ranges from 20 Hz to 20 kHz, and human voices are present in a range of about 200 Hz to 3 kHz. An input audio signal may include components of a high-frequency zone of 7 kHz or higher in which human voices are hardly present in addition to a band in which human voices are present.

In recent years, users' demands for advancement of networks and high-quality services have increased more and more. Audio signals are transmitted via broad bands such as a narrowband (hereinafter, referred to as "NB"), a wideband (hereinafter, referred to as "WB"), and a super wideband (hereinafter, referred to as "SWB").

In this regard, when a coding method suitable for an NB (with a sampling rate up to about 8 kHz) is applied to WB signals (with a sampling rate up to about 16 kHz), there is a problem in that sound quality degrades.

When a coding method suitable for an NB (with a sampling rate up to about 8 kHz) or a coding method suitable for a WB (with a sampling rate up to about 16 kHz) is applied to SWB signals (with a sampling rate up to about 32 kHz), there is also a problem in that sound quality degrades.

Therefore, development of voice and audio encoder/decoder has progressed which can be used in various bands of an NB to a WB or an SWB or in various environments including communication environments between various bands.

SUMMARY OF THE INVENTION

Technical Problem

An object of the present invention is to provide encoding/decoding methods and encoder/decoder which can reduce quantization noise without using an additional bit in applying a sinusoidal mode.

Another object of the present invention is to provide a method and a device for transmitting additional information without an increase in a bit rate and processing a voice signal in a sinusoidal mode.

Another object of the present invention is to provide a method and a device which can enhance coding efficiency and reduce quantization noise by transmitting additional information without a change in bitstream structure.

Solution to Problem

According to an aspect of the present invention, there is provided a voice signal encoding method including the steps of: converting sinusoidal components constituting an input voice signal and generating transform coefficients of the sinusoidal components; determining the transform coefficients to be encoded out of the generated transform coefficients; and transmitting index information indicating the determined transform coefficients, wherein the index information includes position information, amplitude information, and sign information of the transform coefficients, and wherein when the transform coefficients to be encoded are neighboring transform coefficients, the position information duplicatively indicates the same position.

The step of determining the transform coefficients to be encoded may include searching for a first transform coefficient having the maximum amplitude and a second transform coefficient having the second maximum amplitude in consideration of the amplitudes of the transform coefficients, and determining one of three combinations of the first transform coefficient and the second transform coefficient; the first transform coefficient and the transform coefficients adjacent to the first transform coefficient; and the second transform coefficient and the transform coefficients adjacent to the second transform coefficient to be the transform coefficients to be encoded.

In this case, a means square error (MSE) of the first transform coefficient and the second transform coefficient, an MSE of the first transform coefficient and the transform coefficients adjacent to the first transform coefficient, and an MSE of the second transform coefficient and the transform coefficients adjacent to the second transform coefficient may be compared with each other and the combination of transform coefficients having a minimum MSE may be determined to be the transform coefficients to be encoded.

Alternatively, the sum of residual coefficients of the first transform coefficient and the second transform coefficient, the sum of residual coefficients of the first transform coefficient and the transform coefficients adjacent to the first transform coefficient, and the sum of residual coefficients of the second transform coefficient and the transform coefficients adjacent to the second transform coefficient may be compared with each other and the combination of transform coefficients having a minimum sum of residual coefficients may be determined to be the transform coefficients to be encoded.

The transform coefficients adjacent to the first transform coefficient may be excluded from the transform coefficients to be encoded when signs of two transform coefficients adjacent to the first transform coefficient are not equal to each other, and the transform coefficients adjacent to the second transform coefficient may be excluded from the transform coefficients to be encoded when signs of two transform coefficients adjacent to the second transform coefficient are not equal to each other.

The step of transmitting the index information may include transmitting information indicating a sign of the first transform coefficient to be encoded in regard to the signs of the transform coefficients to be encoded.

The position information may duplicatively indicate the first transform coefficient when the first transform coefficient and the transform coefficients adjacent to the first transform coefficient are determined to be the transform coefficients to be encoded, and the position information may duplicatively indicate the second transform coefficient when the second transform coefficient and the transform coefficients adjacent to the second transform coefficient are determined to be the transform coefficients to be encoded.

The sinusoidal components to be encoded may be signals belonging to a super-wide band.

According to another aspect of the present invention, there is provided a voice signal decoding method including the steps of: receiving a bitstream including voice information; reconstructing transform coefficients of sinusoidal components constituting a voice signal on the basis of index information included in the bitstream; and inversely transforming the reconstructed transform coefficients to reconstruct the voice signal.

The step of reconstructing the transform coefficients may include reconstructing the transform coefficients at the indicated position and a position adjacent to the indicated position when the index information duplicatively indicates the same position.

The index information may include position information, amplitude information, and sign information of the transform coefficients, and the position information may indicate a first transform coefficient having a maximum amplitude in a track and a second transform coefficient having a second maximum amplitude in the track, or may duplicatively indicate the first transform coefficient, or may duplicatively indicate the second transform coefficient.

The first transform coefficient and two transform coefficients adjacent to the first transform coefficient may be reconstructed when the position information duplicatively indicates the first transform coefficient, and the second transform coefficient and two transform coefficients adjacent to the second transform coefficient may be reconstructed when the position information duplicatively indicates the second transform coefficient.

The first transform coefficient and two transform coefficients adjacent to the first transform coefficient may be reconstructed to have the same amplitude when the position information duplicatively indicates the first transform coefficient, and the second transform coefficient and two transform coefficients adjacent to the second transform coefficient may be reconstructed to have the same amplitude when the position information duplicatively indicates the second transform coefficient. The first transform coefficient and two transform coefficients adjacent to the first transform coefficient may be reconstructed to have the same sign when the position information duplicatively indicates the first transform coefficient, and the second transform coefficient and two transform coefficients adjacent to the second transform coefficient may be reconstructed to have the same sign when the position information duplicatively indicates the second transform coefficient.

In this case, the reconstructed voice signal may be a super-wideband voice signal.

Advantageous Effects

According to the present invention, it is possible to reduce quantization noise by performing encoding/decoding operations using more effective information without using an additional bit in applying a sinusoidal mode.

According to the present invention, it is possible to enhance coding efficiency and to reduce transmission overhead by transmitting additional information without an increase in a bit rate and processing a voice signal in a sinusoidal mode.

According to the present invention, it is possible to enhance coding efficiency, to reduce quantization noise, and to maintain a bitstream structure to have lower compatibility by transmitting additional information.

According to the present invention, it is possible to provide high-quality voice and audio communication services and to provide various additional services using the same.

DESCRIPTION OF EMBODIMENTS OF THE INVENTION

Figure 1:
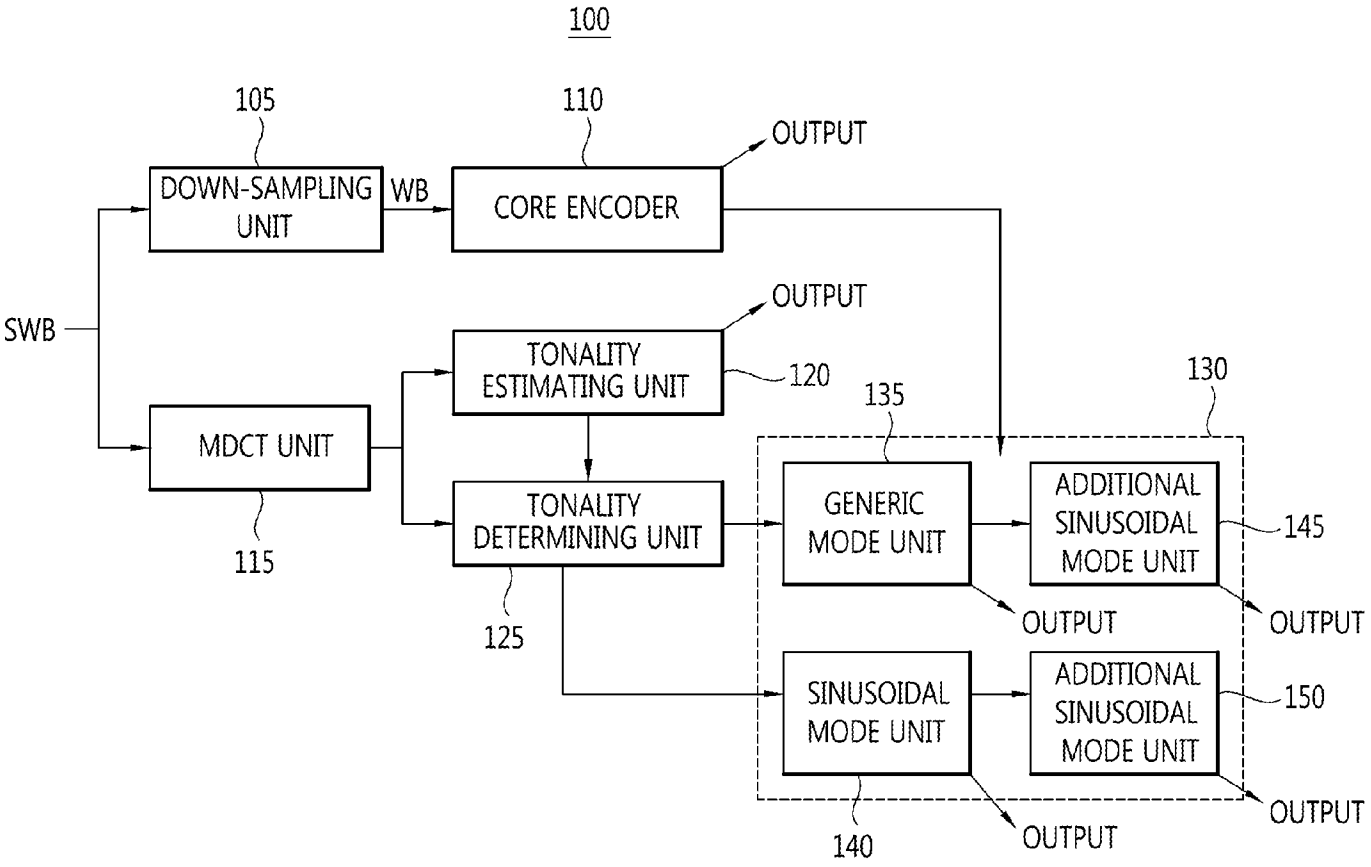
FIG. 1 is a diagram schematically illustrating an example of a configuration of an encoder which can be used to process a super wideband signal using a bandwidth extension method.

Hereinafter, embodiments of the present invention will be specifically described with reference to the accompanying drawings. When it is determined that detailed description of known configurations or functions involved in the present invention makes the gist of the present invention obscure, the detailed description thereof will not be made.

If it is mentioned that an element is "connected to" or "coupled to" another element, it should be understood that still another element may be interposed therebetween, as well as that the element may be connected or coupled directly to another element.

Terms such as "first" and "second" can be used to describe various elements, but the elements are not limited to the terms. The terms are used only to distinguish one element from another element.

The constituent units described in the embodiments of the invention are independently shown to represent different distinctive functions. Each constituent unit is not constructed by an independent hardware or software unit. That is, the constituent units are independently arranged for the purpose of convenience for explanation and at least two constituent units may be combined into a single constituent unit or a single constituent unit may be divided into plural constituent units to perform functions.

In order to satisfy demands for advancement of networks and high-quality services, audio signal processing methods in broad bands of from a NB to a WB or an SWB have been studied. For example, a code excited linear prediction (CELP) coding method, a transform coding method, and a bandwidth and channel extension method have been studied as voice and audio encoding/decoding techniques.

An encoder may be classified into a baseline coder and an enhancement layer. The enhancement layer may be divided into a lower-band enhancement (LBE) layer, a bandwidth extension (BWE) layer, and a higher-band enhancement (HBE) layer.

The LBE layer improves lower-band sound quality by encoding/decoding a difference signal between a sound source processed by a core encoder/core decoder and an original sound, that is, an excited signal. Since a high-frequency signal has similarity to a low-frequency signal, the high-frequency signal can be reconstructed at a low bit rate using a high-bandwidth extension method using a low band.

As a method of extending and encoding a high-frequency signal and reconstructing the encoded signal through the use of a decoding process, a method of scalably extending and processing a SWB signal can be considered. The method of extending the bandwidth of the SWB signal can be carried out in a modified discrete cosine transform (MDCT) domain.

The extension layers can be processed in a generic mode and a sinusoidal mode. For example, when three extension layers are used, the first extension layer may be processed in the generic mode and the sinusoidal mode and the second and third extension layers may be processed in the sinusoidal mode.

In this specification, sinusoids include a sine wave and a cosine wave which is obtained by shifting the sine wave in phase by a half wavelength. Therefore, a sinusoid in the present invention may mean a sine wave or may mean a cosine wave. When an input sinusoid is a cosine wave, the cosine wave may be converted into a sine wave or a cosine wave in the course of encoding/decoding, and this conversion is based on a conversion method of conversion which is performed on the input signal. When an input sinusoid is a sine wave, the sine wave may be converted into a cosine wave or a sine wave in the course of encoding/decoding and this conversion is based on a conversion method which is performed on the input signal.

In the generic mode, coding is performed on the basis of adaptive replication of a coded wideband signal sub-band. In coding in a sinusoidal mode, a sinusoid is added to high-frequency contents. The sinusoidal mode is an efficient encoding technique of a signal having strong periodicity or a signal having tonality and can encode sign, amplitude, and position information of each sinusoidal component. A predetermined number of, for example, ten, MDCT coefficients can be encoded for each layer.

FIG. 1 is a diagram schematically illustrating an example of a configuration of an encoder which can be used when a super wideband signal is processed using a bandwidth extension method.

Referring to FIG. 1, the encoder 100 includes a down-sampling unit 105, a core encoder 110, an MDCT unit 115, a tonality estimating unit 120, a tonality determining unit 125, and an SWB encoding unit 130. The SWB encoding unit 130 includes a generic mode unit 135, a sinusoidal mode unit 140, and additional sinusoidal mode units 145 and 150.

When an SWB signal is input, the down-sampling unit 105 down-samples the input signal and generates a WB signal which can be processed by the core encoder.

The SWB encoding is performed in an MDCT domain. The core encoder 110 performs an MDCT operation on a WB signal synthesized by encoding a WB signal, and outputs MDCT coefficients.

The MDCT unit 115 performs an MDCT operation on an SWB signal and the tonality estimating unit 120 estimates tonality of the signal subjected to the MDCT operation. Which of the generic mode and the sinusoidal mode to select is determined on the basis of the tonality. For example, when three layers are used in a scalable SWB bandwidth extension method, the first layer, that is, layer 6 mo (layer 7 mo) can be selected on the basis of the estimation of tonality. The generic mode and/or the sinusoidal mode may be used for layer 6 mo out of three layers, and the sinusoidal mode may be used for upper layers (layer 7 mo and layer 8 mo).

The estimation of tonality may be performed on the basis of correlation analysis between spectral peaks in a current frame and a past frame.

The tonality estimating unit 120 outputs the estimated tonality value to the tonality determining unit 125.

The tonality determining unit 125 determines when the signal subjected to the MDCT is tonal on the basis of a degree of tonality and transmits the determination result to the SWB encoding unit 130. For example, the tonality determining unit 125 compares the estimated tonality value input from the tonality estimating unit 120 with a predetermined reference value and determines whether the signal subject to the MDCT is a tonal signal.

As illustrated in the drawing, the SWB encoding unit 130 processes the MDCT coefficients of the SWB signal subjected to the MDCT. At this time, the SWB encoding unit 130 can process the MDCT coefficients of the SWB signal using the MDCT coefficients of the synthesized WB signal input from the core encoder 110.

When it is determined by the tonality determining unit 125 that the signal subjected to the MDCT is not tonal, the signal is transmitted to the generic mode unit 135. When it is determined that the signal subjected to the MDCT is tonal, the signal is transmitted to the sinusoidal mode unit 140.

The generic mode can be used when it is determined that an input frame is not tonal. A low-frequency spectrum is directly transposed to high-frequency spectrums and a parameter is made to comply with an envelope of original high frequencies. At this time, the parameter is made more coarsely in comparison with a case of the original high frequencies. By applying the generic mode, it is possible to code high-frequency contents at a low bit rate.

For example, in the generic mode, a high-frequency band is divided into sub-bands and most similar contents out of wideband contents which are encoded and envelope-normalized are selected depending on a predetermined similarity determination criterion. The selected contents are scaled and then output as synthesized high-frequency contents.

The sinusoidal mode unit 140 may be used when an input frame is tonal. In the sinusoidal mode, a finite set of sinusoidal components is added to a high-frequency (HF) spectrum to generate an SWB signal. At this time, the HF spectrum is generated using MDCT coefficients of a synthesized SW signal.

The additional sinusoidal mode units 145 and 150 add an additional sinusoid to a signal output in the generic mode and a signal output in the sinusoidal mode to enhance a generated signal. For example, when an additional bit is allocated, the additional sinusoidal mode units 145 and 150 determines an additional sinusoid (pulse) to be transmitted and extends the sinusoidal mode for quantization to enhance a signal.

On the other hand, as illustrated in the drawing, the outputs of the core encoder 110, the tonality determining unit 125, the generic mode unit 135, the sinusoidal mode unit 140, and the additional sinusoidal mode units 145 and 150 can be transmitted to the decoder as a bitstream.

Figure 2:
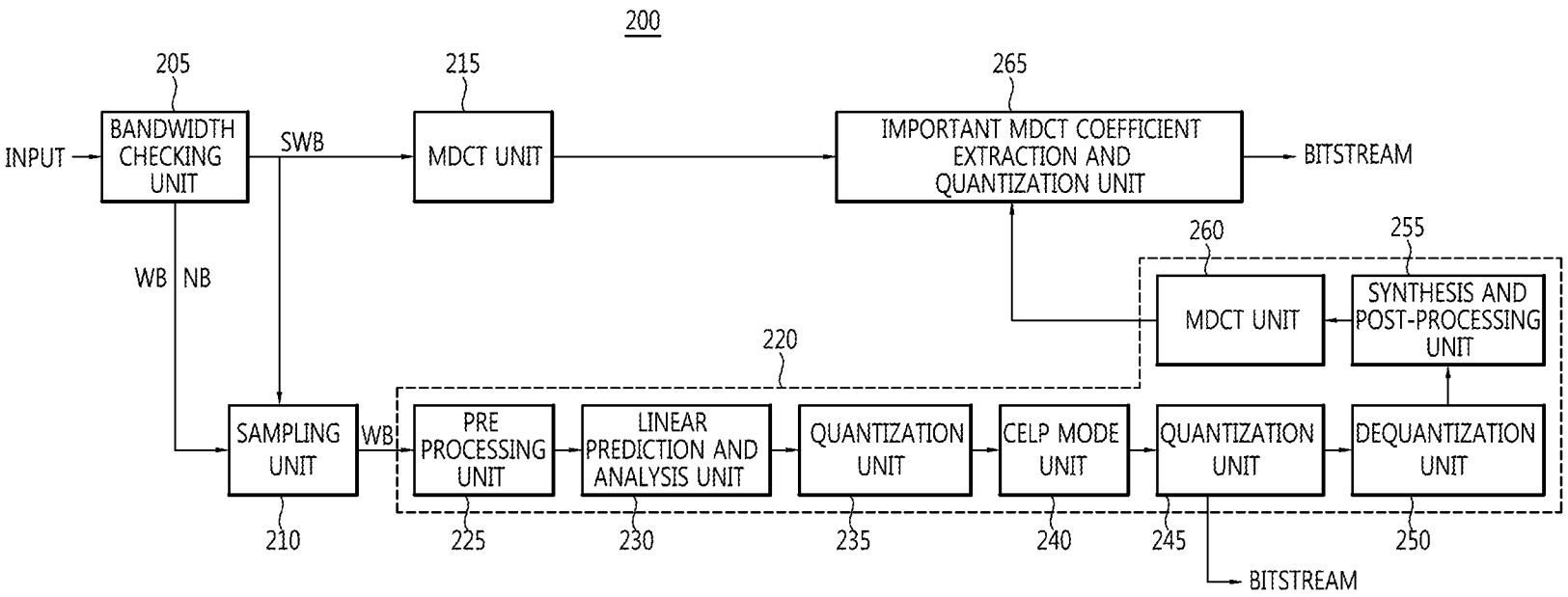
FIG. 2 is a diagram illustrating an example of the configuration of the encoder with a focus on a configuration of a core encoder.

FIG. 2 is a diagram illustrating an example of a configuration of the encoder with a focus on the configuration of the core encoder. Referring to FIG. 2, the encoder 200 includes a bandwidth checking unit 205, a sampling and conversion unit 210, an MDCT unit 215, a core encoding unit 220, and an important MDCT coefficient extracting and quantization unit 265.

The bandwidth checking unit 205 may check whether an input signal (voice signal) is an Narrow Band (NB) signal, a Wide Band (WB) signal, or an Super Wide Band (SWB) signal. The sampling rate of the NB signal may be 8 kHz, the sampling rate of the WB signal may be 16 kHz, and the sampling rate of the SWB signal may be 32 kHz.

The bandwidth checking unit 205 may transform the input signal to a frequency domain and may check components and presence of upper-band bins.

When the input signal is fixed, for example, when the input signal is fixed to the NB, the encoder 200 may not include the bandwidth checking unit 205.

The bandwidth checking unit 205 determines the input signal, outputs the NB or WB signal to the sampling and conversion unit 210, and outputs the SWB signal to the sampling and conversion unit 210 or the MDCT unit 215.

The sampling and conversion unit 210 performs a sampling operation of converting the input signal into the WB signal to be input to the core encoder 220. For example, the sampling and conversion unit 210 performs an up-sampling operation so as to obtain a signal with a sampling rate of 12.8 kHz when the input signal is an NB signal, and performs a down-sampling operation so as to obtain a signal with a sampling rate of 12.8 kHz when the input signal is a WB signal, thereby generating a lower-band signal of 12.8 kHz. When the input signal is an SWB signal, the sampling and conversion unit 210 performs a down-sampling operation so as to obtain a signal with a sampling rate of 12.8 kHz and generates an input signal to be input to the core encoder 220.

The core encoder 220 includes a pre-processing unit 225, a linear prediction and analysis unit 230, a quantization unit 235, a CELP mode unit 240, a quantization unit 245, a dequantization unit 250, a synthesis and post-processing unit 255, and an MDCT unit 260.

The pre-processing unit 225 may filter low-frequency components of lower-band signals input to the core encoder 220 and may transmit only a desired band signal to the linear prediction and analysis unit.

The linear prediction and analysis unit 230 may extract linear prediction coefficients (LPC) from the signals processed by the pre-processing unit 225. For example, the linear prediction and analysis unit 230 may extract 16-order linear prediction coefficients from the input signal and may transmit the extracted linear prediction coefficients to the quantization unit 235.

The quantization unit 235 quantizes the linear prediction coefficients transmitted from the linear prediction and analysis unit 230. A linear prediction residual signal is generated through filtering with an original lower-band signal using the linear prediction coefficients quantized in the lower band.

The linear prediction residual signal generated by the quantization unit 235 is input to the CELP mode unit 240.

The CELP mode unit 240 detects a pitch of the input linear prediction residual signal using a self-correlation function. At this time, a first open-loop pitch searching method, a first closed-loop pitch searching method, an analysis-by-synthesis (AbS) method, or the like may be used.

The CELP mode unit 240 may extract an adaptive codebook index and gain information on the basis of information of the detected pitch. The CELP mode unit 240 may extract a fixed codebook index and a gain on the basis of the components in the linear prediction residual signal other than components contributing to the adaptive codebook index.

The CELP mode unit 240 transmits the parameters (pitch, adaptive codebook index and gain, and fixed codebook index and gain) relevant to the linear prediction residual signal extracted through the pitch search, the adaptive codebook search, and the fixed codebook search to the quantization unit 245.

The quantization unit 245 quantizes the parameters transmitted from the CELP mode unit 240.

The parameters relevant to the linear prediction residual signal quantized by the quantization unit 245 may be output as a bitstream and may be transmitted to the decoder. The parameters relevant to the linear prediction residual signal quantized by the quantization unit 245 may be transmitted to the dequantization unit 250.

The dequantization unit 250 generates a reconstructed excited signal using the parameters extracted and quantized in the CELP mode. The generated excited signal is transmitted to the synthesis and post-processing unit 255.

The synthesis and post-processing unit 255 synthesizes the reconstructed excited signal and the quantized linear prediction coefficients, generates a synthesis signal of 12.8 kHz, and reconstructs a WB signal of 16 kHz through up-sampling.

The MDCT unit 260 transforms the reconstructed WB signal using a Modified Discrete Cosine Transform (MDCT) method. The WB signal subjected to the MDCT is output to the important MDCT coefficient extracting and quantization unit 265.

The important MDCT coefficient extracting and quantization unit 265 corresponds to the SWB encoding unit illustrated in FIG. 1. The important MDCT coefficient extracting and quantization unit 265 receives the MDCT transform coefficients of the SWB from the MDCT unit 215, and receives the MDCT transform coefficients of the synthesized WB from the MDCT unit 260.

The important MDCT coefficient extracting and quantization unit 265 extracts the transform coefficients to be quantized using the MDCT transform coefficients. Details of causing the important MDCT coefficient extracting and quantization unit 265 to extract the MDCT coefficients are the same as described for the SWB encoding unit of FIG. 1.

The important MDCT coefficient extracting and quantization unit 265 quantizes the MDCT coefficients, and outputs and transmits the quantized MDCT coefficients as a bitstream to the decoder.

Figure 3:
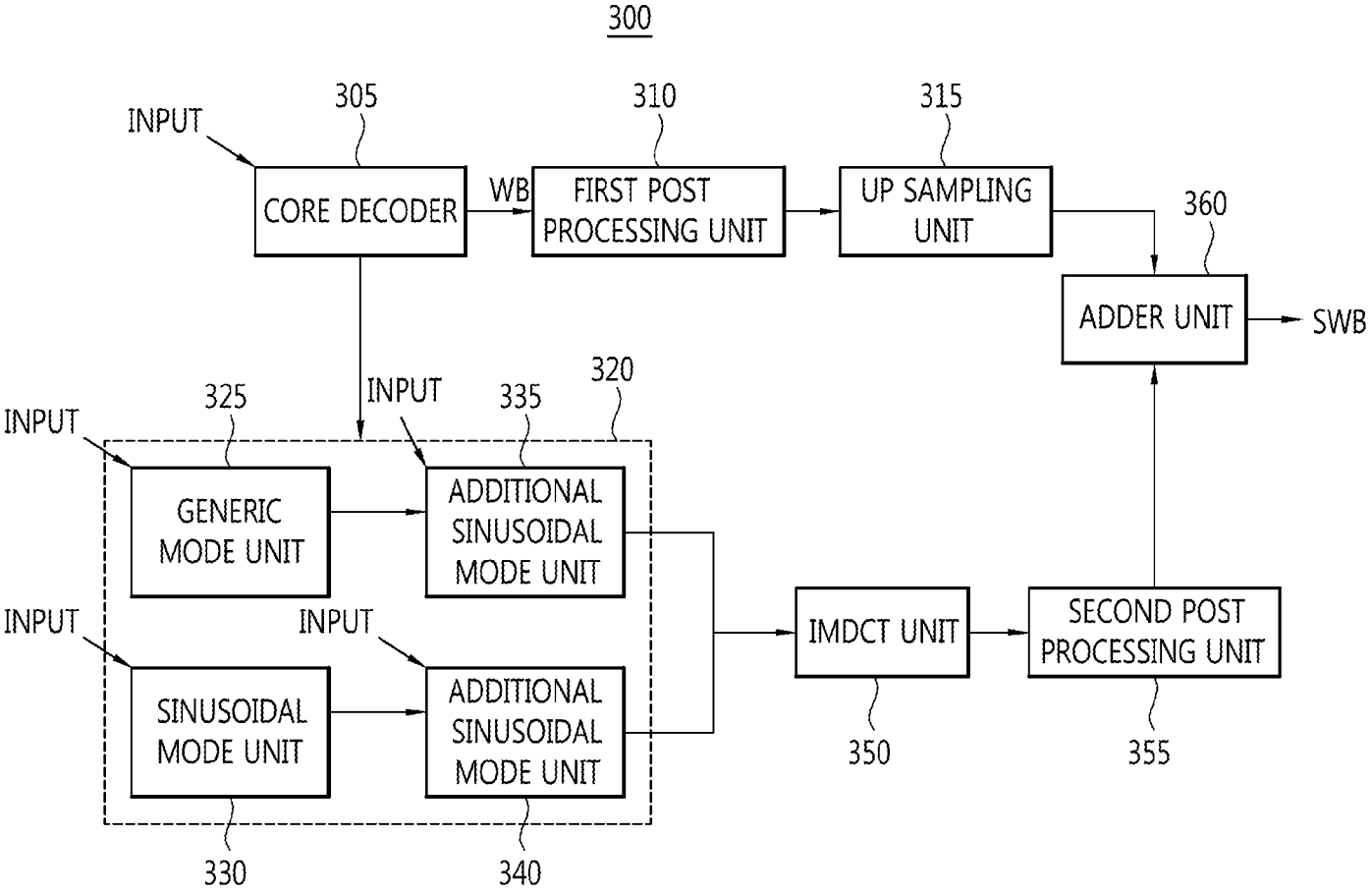
FIG. 3 is a diagram schematically illustrating an example of a configuration of a decoder which can be used to process a super wideband signal using a bandwidth extension method.

FIG. 3 is a diagram schematically illustrating an example of the configuration of the decoder which can be used to process an SWB signal using a bandwidth extension method.

Referring to FIG. 3, the decoder 300 includes a core decoder 305, a first post-processing unit 310, an up-sampling unit 315, an SWB decoding unit 320, an IMDCT unit 350, a second post-processing unit 355, and an adder unit 360. The SWB decoding unit 320 includes a generic mode unit 325, a sinusoidal mode unit 330, and additional sinusoidal mode units 335 and 340.

As illustrated in the drawing, target information to be processed and/or auxiliary information for the processing may be input from a bitstream to the code decoder 305, the generic mode unit 325, the sinusoidal mode unit 330, and the additional sinusoidal mode unit 335

The core decoder 305 decodes a WB signal and synthesizes WB signal. The synthesized WB signal is input to the first post-processing unit 310 and the MDCT transform coefficients of the synthesized WB signal is input to the SWB decoding unit 320.

The first post-processing unit 310 enhances the synthesized WB signal in the time domain.

The up-sampling unit 315 up-samples the WB signal to construct an SWB signal.

The SWB decoding unit 320 decodes the MDCT transform coefficients of the SWB signal input from the bitstream. At this time, the MDCT coefficients of the synthesized WB signal input from the core decoder 305 may be used. The decoding of the SWB signal is mainly performed in the MDCT domain.

The generic mode unit 325 and the sinusoidal mode unit 330 decode the first layer of the extension layers, and the upper layers can be decoded by the additional sinusoidal mode units 335 and 340.

The SWB decoding unit 320 performs a decoding process in the reverse order of the encoding process described for the SWB encoding unit. At this time, the SWB decoding unit 320 determines whether the information input from the bitstream is tonal, the sinusoidal mode unit 330 or the sinusoidal mode unit 330 and the additional sinusoidal mode unit 340 perform the decoding process when it is determined that the information is tonal, the generic mode unit 325 or the generic mode unit 325 and the additional sinusoidal mode unit 335 perform the decoding process when it is determined that the information is not tonal.

For example, the generic mode unit 325 constructs the HF signal by adaptive sub-band replication. Then, two sinusoidal components are added to the spectrum of the first SWB extension layer. The generic mode and the sinusoidal mode use similar enhancement layers serving as a basis of sinusoidal mode coding.

The sinusoidal mode unit 330 generates an High Frequency (HF) signal on the basis of a finite set of sinusoidal components. The additional sinusoidal units 335 and 340 add a sinusoid to the upper SWB layer to improve quality of high-frequency contents.

An IMDCT unit 350 performs an inverse MDCT and outputs a signal in the time domain, and the second post-processing unit 355 enhances the signal subjected to the inverse MDCT process in the time domain.

The adder unit 360 adds the SWB signal decoded and up-sampled by the core decoder and the SWB signal output from the SWB decoding unit 320 and outputs a reconstructed signal.

Figure 4:
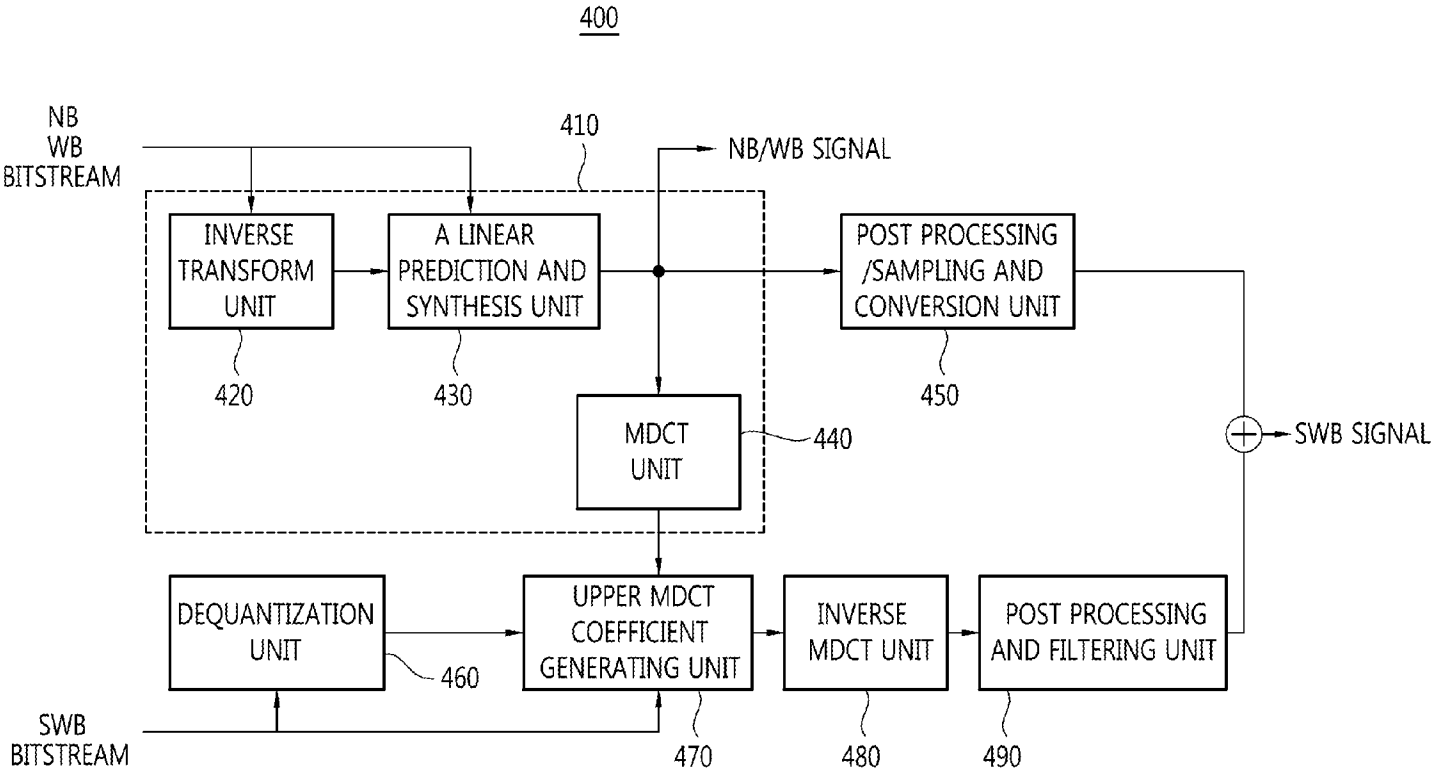
FIG. 4 is a diagram illustrating an example of the configuration of the decoder with a focus on a configuration of a core decoder.

FIG. 4 is a diagram illustrating an example of the configuration of the decoder with a focus on the configuration of the core decoder. Referring to FIG. 4, the decoder 400 includes a core decoder 410, a post-processing/sampling and conversion unit 450, a dequantization unit 460, an upper MDCT coefficient generating unit 470, an inverse MDCT unit 480, and a post-processing and filtering unit 490.

A bitstream including an NB signal or a WB signal transmitted from the encoder is input to the core decoder 410.

The core decoder 410 includes an inverse transform unit 420, a linear prediction and synthesis unit 430, and an MDCT unit 440.

The inverse transform unit 420 may inversely transform voice information encoded in the CELP mode and may reconstruct an excited signal on the basis of the parameters received from the encoder. The inverse transform unit 420 may transmit the reconstructed excited signal to the linear prediction and synthesis unit 430.

The linear prediction and synthesis unit 430 may reconstruct a lower-band signal (such as the NB signal and the WB signal) using the excited signal transmitted from the inverse transform unit 420 and the linear prediction coefficients transmitted from the encoder.

The lower-band signal (12.8 kHz) reconstructed by the linear prediction and synthesis unit 430 may be down-sampled to the NB or may be up-sampled to the WB. The WB signal may be output to the post-processing/sampling and conversion unit 450 or may be output to the MDCT unit 440.

The post-processing/sampling and conversion unit 450 may up-sample the NB signal or the WB signal and may generate a synthesized signal to be used to reconstruct the SWB signal.

The MDCT unit 440 performs an MDCT operation on the reconstructed lower-band signal and transmits the resultant signal to the upper MDCT coefficient generating unit 470.

The dequantization unit 460 and the upper MDCT coefficient generating unit 470 correspond to the SWB decoding unit of the decoder illustrated in FIG. 3.

The dequantization unit 460 receives the quantized SWB signal and parameters from the encoder using the bitstream and dequantizes the received information.

The dequantized SWB signal and parameters are transmitted to the upper MDCT coefficient generating unit 470.

The upper MDCT coefficient generating unit 470 receives the MDCT coefficients of the synthesized NB signal or WB signal from the core decoder 410, receives the necessary parameters from the bitstream of the SWB signal, and generates the MDCT coefficients of the dequantized SWB signal. As illustrated in FIG. 3, the upper MDCT coefficient generating unit 470 can apply the generic mode or the sinusoidal mode depending on whether the signal is tonal, and can apply the additional sinusoidal mode to a signal of the extension layer.

The inverse MDCT unit 480 reconstructs a signal by inverse transform on the generated MDCT coefficients.

The post-processing and filtering unit 490 may perform a filtering operation on the reconstructed signal. Post-processing such as reducing a quantization error, emphasizing a peak, and dampening a valley can be performed by the filtering.

The signal reconstructed by the post-processing and filtering unit 490 and the signal reconstructed by the post-processing/sampling and conversion unit 450 may be synthesized to reconstruct the SWB signal.

In the bandwidth extension method, as illustrated in FIGS. 1 to 4, the SWB input signal is processed by the core encoder and the enhancement layer processing unit (SWB encoding unit) so as to encode the SWB input signal. In order to decode the SWB signal, the SWB signal is processed by the core decoder and the enhancement layer processing unit (SWB decoding unit).

In order to encode signal information corresponding to the WB out of the SWB input signal, the SWB signal is down-sampled at a sampling rate corresponding to the WB and is encoded by the WB encoder (core encoder).

For use in encoding the SWB signal, the encoded WB signal is synthesized and then subjected to the MDCT, and the MDCT coefficients of the WB may be input to the SWB encoding unit. The SWB input signal is encoded in the generic mode and the sinusoidal mode depending on the degree of tonality in the MDCT coefficient domain. In order to enhance the coding efficiency, the enhancement layer may be additionally encoded using an additional sinusoid.

The signal information corresponding to the WB out of the SWB signal is decoded by the WB decoder (core decoder). The decoded WB signal is synthesized and then subjected to the MDCT, and the MDCT coefficients of the WB may be input to the SWB decoding unit. The encoded SWB signal is decoded in the generic mode and the sinusoidal mode depending on the encoded mode, and the enhancement layer may be additionally encoded using an additional sinusoid. The inversely-transformed SWB signal and WB signal may be synthesized through an additional post-processing such as up-sampling and may then be reconstructed as the SWB signal.

The sinusoidal mode according to the present invention will be described below.

The sinusoidal mode is a mode of encoding only a sinusoid having large energy out of sinusoids constituting a voice signal instead of encoding all sinusoids (also referred to as sinusoidal components constituting a voice signal) constituting the voice signal. Accordingly, unlike encoding of all sinusoids, the encoder in the sinusoidal mode encodes position information of a selected sinusoid as well as amplitude information and sign information of the selected sinusoid and transmits the encoded information to the decoder.

At this time, the "sinusoids" constituting a voice signal means the MDCT coefficients X(k) obtained by performing an MDCT operation on the sinusoids constituting the voice signal. Therefore, in this specification, when characteristics of a sinusoid in the sinusoidal mode are described, it should be noted that the amplitude of a sinusoid means the amplitude (C) of the MDCT coefficient obtained by performing the MDCT operation on the corresponding sinusoidal component, the sign (sign) of the corresponding sinusoidal component, and the position (pos) of the corresponding sinusoidal component. The position of a sinusoid is a position in the frequency domain and may be a wave number k for specifying each sinusoid constituting the voice signal or may be an index corresponding to the wave number (k).

In this specification, for the purpose of explanation, it should be noted that the MDCT coefficient of each sinusoidal component constituting a voice signal is simply referred to as a "sinusoid" or a "pulse". Therefore, in this specification, a "sinusoid" or a "pulse" may mean an MDCT coefficient of each sinusoidal component constituting an input voice signal, as long as it is not mentioned particularly differently.

In this specification, for the purpose of explanation, the position of a sinusoid is specified by the wave number of the sinusoid. Here, this is for convenience of explanation and the present invention is not limited to this assumption. Details of the present invention will be similarly applied even when particular information for specifying positions of sinusoids in the frequency domain may be used as a position of a sinusoid.

The sinusoidal mode is not suitable for encoding all sinusoids, because the position information of the sinusoids should be transmitted, but is effective when sound quality should be guaranteed using a small number of sinusoids or the sinusoids should be transmitted using a low bit rate. Therefore, the sinusoidal mode can be used in the bandwidth extension technique or a voice codec with a low bit rate.

Figure 5:
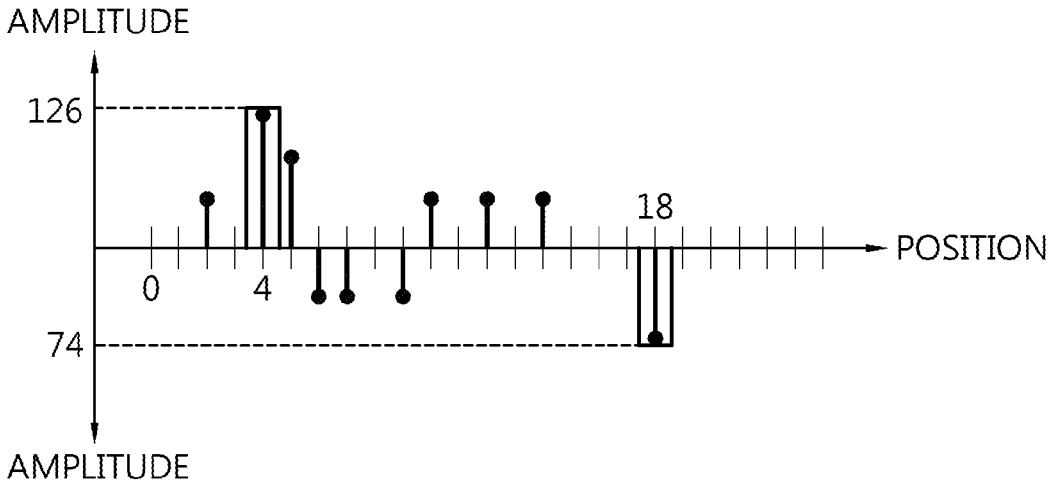
FIG. 5 is a diagram schematically illustrating a method of encoding a sinusoid in a sinusoidal mode.

FIG. 5 is a diagram schematically illustrating a method of encoding a sinusoid in the sinusoidal mode.

Referring to FIG. 5, sinusoids constituting an input voice signal are located to correspond to the wave numbers (k) of the sinusoids.

Sinusoids facing the upper side represent MDCT coefficients having a positive value, and sinusoids facing the lower side represent MDCT coefficients having a negative value. The amplitude of a sinusoid (MDCT coefficient) corresponds to the length of the sinusoid.

FIG. 5 illustrates an example where a positive sinusoid having an amplitude of 126 is located at position 4 and a negative sinusoid having an amplitude of 74 is located at position 18. In the sinusoidal mode, as described above, the amplitude information, the sign information, and the position information of the sinusoids are transmitted.

When it is assumed that two sinusoids having a maximum amplitude are retrieved and the corresponding information is encoded, information (amplitude: 126, sign: +, position: 4) of the first sinusoid located at position 4 and information (amplitude: 74, sign: –, position: 18) of the second sinusoid can be encoded.

Figure 6:
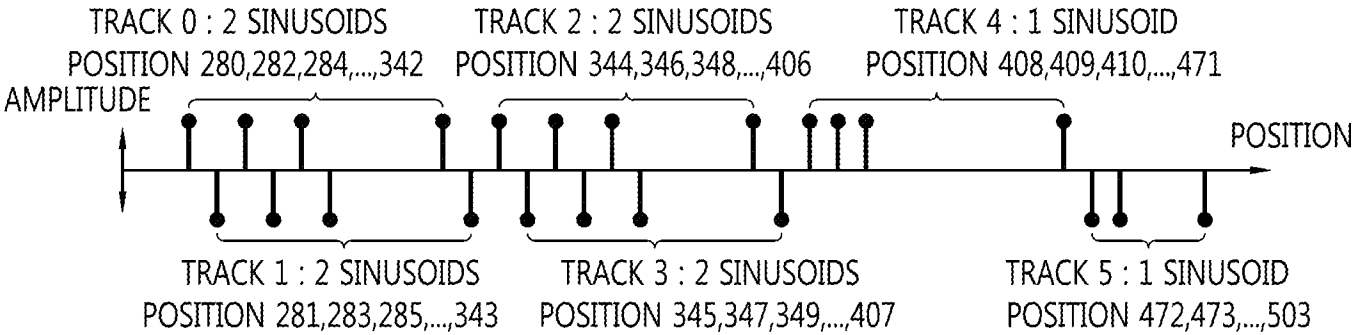
FIG. 6 is a diagram schematically illustrating an example of track information in a sinusoidal mode in layer 6 which is a first SWB layer.

FIG. 6 is a diagram schematically illustrating an example of track information on the sinusoidal mode in layer 6 which is the first SWB layer.

In the example illustrated in FIG. 6, sinusoids (MDCT coefficients) constituting a voice signal in the frequency domain are marked at the positions corresponding to the wave numbers of the sinusoids.

Track 0 is located in a frequency section of 280 to 342 and includes sinusoids having intervals of 2 in terms of position unit (for example, wave number or frequency). Track 1 is located in a frequency section of 281 to 343 and includes sinusoids having intervals of 2. Track 2 is located in a frequency section of 344 to 406 and includes sinusoids having intervals of 2. Track 3 is located in a frequency section of 345 to 407 and includes sinusoids having intervals of 2. Track 4 is located in a frequency section of 408 to 471 and includes sinusoids having intervals of 1. Track 5 is located in a frequency section of 472 to 503 and includes sinusoids having intervals of 1.

In the sinusoidal mode, a predetermined number of sinusoids satisfying a predetermined condition are retrieved for each tack in the track order and the retrieved sinusoids are quantized. It should be noted that the retrieved and quantized sinusoids are the MDCT coefficients of the sinusoids as described above.

In layer 6, two sinusoids are retrieved and quantized in each of four tracks of track 0 to track 3 depending on the bit allocation, and one sinusoid is retrieved and quantized in each of track 4 and track 5.

The retrieval in each track is to retrieve maximum sinusoids, that is, sinusoids having a maximum amplitude, in the track to correspond to the number of sinusoids allocated to each track. Therefore, in the example illustrated in FIG. 5, two sinusoids having the maximum amplitude are retrieved in track 0, track 1, track 2, and track 3 and a sinusoid having the maximum amplitude is retrieved in track 4 and track 5.

In layer 6 which is the first SWB layer, the sinusoidal mode may be performed by the sinusoidal mode unit illustrated in FIGS. 1 and 3.

The sinusoidal mode may be encoded by extracting 10 pulses (sinusoids) from HF signals. The first four pulses can be extracted from a band of 7000 Hz to 8600 Hz, and the next four pulses can be extracted from a band of 8600 Hz to 10200 Hz, and the next pulse can be extracted from a band of 10200 Hz to 11800 Hz, and the last pulse can be extracted from a band of 11800 Hz to 12699 Hz.

The retrieved pulses may be quantized.

The position of the retrieved pulse, that is, the position of the maximum pulse, may be determined using a difference between an original signal $M_{32}(k)$ in the current layer and an HF synthesized signal $\ddot{M}_{32}(k)$ in the previous layer. Expression 1 shows an example of a method of determining the difference value.

$$D(k)=|\ddot{M}_{32}(k)-M_{32}(k)|, k=280, \ldots, 559 \quad \text{<Expression 1>}$$

In Expression 1, M represents the amplitude of an MDCT coefficient, and k represents the wave number as a position of a pulse (sinusoid). Therefore, $M_{32}(k)$ represents the amplitude of the pulse at position k in the SWB up to 32 kHz.

The sinusoidal mode of layer 6 may be set to 0 as an initial value, because the HF synthesized signal is not present. The course of calculating the difference value using Expression 1 in layer 6 can be said to calculate the maximum value of $M_{32}(k)$.

Regarding D(k), a band is divided into five sub-bands to form $D_j(k)$ (where $0 \le j \le 4$ or $1 \le j \le 5$). The number of pulses in each sub-band has a predetermined value of $N_j$ (where N is an integer).

Table 1 shows an example of a method of retrieving $N_j$ maximum pulses for each sub-band.

TABLE 1

```
for j=0 to N
    data_sorted(j)=0
    data_sorted(j)=0
    Idx=0
    for k+1 tolength(input_data)
        if(input_data(j)>data_sorted(j))
            index_sorted(j)=k
            Idx=k
        end
    end
end
```

The maximum value N is retrieved using the arrangement method shown in Table 1 and the retrieved value of N is stored in a parameter input_data.

Table 2 shows the number of pulse extracted for each sub-band $D_j(k)$ and the ranges thereof in layer 6.

TABLE 2

| Track | Number of sinusoids | Starting position | Position step size | Length |
|---|---|---|---|---|
| 0 | 2 | 280 | 2 | 32 |
| 1 | 2 | 281 | 2 | 32 |
| 2 | 2 | 344 | 2 | 32 |
| 3 | 2 | 345 | 2 | 32 |
| 4 | 1 | 408 | 1 | 64 |
| 5 | 1 | 472 | 1 | 32 |

Table 2 shows the number of sinusoids (pulses) extracted as sinusoids to be encoded through retrieval for each track, the start position (retrieval start position) of each track, the position step size in each track, and the number of pulses in each track.

$N_j$ pulses extracted for each track have position information $pos_j(1)$ (where 1=0, . . . , $N_j$) and the position information is associated with the starting position of each track.

The amplitude $c_j(1)$ of the extracted pulse can be encoded as follows.

$$c_j(1)=\log(|D_j(pos_j(1))|) \quad \text{<Expression 2>}$$

In Expression 2, the amplitude value is encoded but the sign information is lost. Therefore, the sign value of a pulse can be particularly encoded using Expression 3.

$$\text{Sign_sin}_j(l) = \begin{cases} 1 & D_j(pos_j(l)) >= 0 \\ -1 & \text{otherwise} \end{cases} \quad \text{⟨Expression 3⟩}$$

When $N_j$ is equal to 2, both sign values of the retrieved two pulses are not transmitted, but the signal value of the first pulse of each track is transmitted. The sign value of the other pulse can be induced using Table 3 at the time of encoding the sign value of the first pulse.

TABLE 3

```
If
    (pos_j(0)< pos_j(1) and Sign_sin_j(0)≠Sign_sin_j(1))
    or
    (pos_j(0)> pos_j(1) and Sign_sin_j(0)=Sign_sin_j(1))
        pos_tmp=pos_j(0), pos_j(0)=pos_j(1), pos_j(1)=pos_tmp
        Sign_tmp=Sign_sin_j(0),
        Sign_sin_j(0)=Sign_sin_j(1), Sign_sin_j(1)=Sign_tmp
        c_tmp=c_j(0), c_j(0)=c_j(1), c_j(1)=c_tmp
end
```

In Table 3, $pos_j(0)$, $Sign_sin_j(0)$, and $c_j(0)$ represent the position, the sign, and the amplitude of the larger pulse, respectively, and $pos_j(1)$, $Sign_sin_j(1)$, and $c_j(1)$ represent the position, the sign, and the amplitude of the smaller pulse, respectively.

According to the method shown in Table 3, the signs of the two pulses are induced to be equal to each other when the larger pulse is located prior to the smaller pulse on the frequency axis, the signs of the two pulses are induced to be different from each other when the large pulse is located posterior to the smaller pulse on the frequency axis. Accordingly, when the decoder receives information arranged using the method shown in Table 3 by the encoder, the signs of the two pulses can be induced.

In layer 6, the encoding is performed using the original signal as a target signal in Expression 1. However, in an upper layer of layer 6, that is, in layer 7 or layer 8, the encoding is performed using the difference between the original signal in the previous layer and the synthesized signal in the upper layer as a target signal, as expressed in Expression 1.

The encoding method performed in the upper layer of layer 6 is similar to the encoding method described above in layer 6.

In encoding of layer 7 which is the first layer of the SWB enhancement layer, 10 pulses are additionally extracted from the HF (7 kHz to 14 kHz) signal. In layer 7, the frequency band to be encoded may be set to be different depending on the generic mode and the sinusoidal mode.

The HF signal $\ddot{M}_{32}^{6mo}(k)$ output in the generic mode is divided into total 8 sub-bands and energy is calculated for each sub-band. Each sub-band includes 32 MDCT coefficients as shown in Table 2, and the method of calculating energy for each sub-band is the same as expressed by Expression 4.

$$SbE_{6mo}(k) = \sum_{n=0}^{n=31} \ddot{M}_{32}^{6mo}(280 + k \times 32 + n)^2 \quad \text{⟨Expression 4⟩}$$

$$k = 0, \ldots$$

In Expression 4, $\ddot{M}_{32}^{6mo}(k)$ represents the HF signal synthesized again in the generic mode.

In layer 7, the 8 sub-bands are sequentially arranged in the order of energy magnitude from the sub-band having the highest energy in consideration of energy values of the sub-bands. 5 sub-bands having the highest energy are selected out of the arranged sub-bands, and 5 pulses are extracted for each sub-band using the sinusoidal coding method described for layer 6. At this time, the position of the track defined in the sinusoidal coding method varies depending on energy features of the HF signal for each frame.

Total 10 pulses extracted from the HF signal $\ddot{M}_{32}^{6mo}(k)$ output in the sinusoidal mode are extracted through two processes of a process of extracting 4 pulses and a process of extracting 6 pulses. Four pulses are extracted at positions corresponding to a band of 9400 Hz to 11000 Hz and six pulses are extracted at positions corresponding to a band of 11000 Hz to 13400 Hz.

Table 4 shows track information in the sinusoidal mode (sinusoidal mode frame) of layer 7.

TABLE 4

| Track | Number of sinusoids | Starting position | Position step size | Length |
|---|---|---|---|---|
| 0 | 2 | 376 | 2 | 32 |
| 1 | 2 | 377 | 2 | 32 |
| 2 | 2 | 440 | 3 | 32 |
| 3 | 2 | 441 | 3 | 32 |
| 4 | 2 | 442 | 3 | 32 |

Table 4 shows the number of sinusoids extracted as sinusoids to be encoded through retrieval for each track of layer 7, the starting position (retrieval starting position) of each track, the position step size in each track, and the number of pulses in each track.

On the other hand, in layer 8, 20 pulses are additionally extracted and a slight difference is added to the mode of layer 6 similarly to layer 7.

In the generic mode (generic mode frame), two difference processes of extracting 10 pulses are performed.

Regarding 6 pulses out of the first 10 pulses, two pulses are extracted from each of three tracks, and the band in which the pulses are extracted ranges from 9750 Hz to 12150 Hz. Regarding the other 4 pulses out of the first 10 pulses, two pulses are extracted from each of two tracks and the band in which the pulses are extracted ranges from 12150 Hz to 13750 Hz.

The method of extracting the other 10 pulses out of the 20 pulses is similar. Regarding 6 pulses out of the 10 pulses, two pulses are extracted from each of three tracks, and the band in which the pulses are extracted ranges from 8600 Hz to 11000 Hz. Regarding the other 4 pulses out of the pulses, two pulses are extracted from each of two tracks and the band in which the pulses are extracted ranges from 11000 Hz to 12600 Hz.

Table 5 shows an example of a sinusoid track structure in the generic mode frame of layer 8.

TABLE 5

| Track | Number of sinusoids | First Starting position | Second Starting position | Position step size | Length |
|---|---|---|---|---|---|
| 0 | 2 | 390 | 344 | 3 | 32 |
| 1 | 2 | 391 | 345 | 3 | 32 |
| 2 | 2 | 392 | 346 | 3 | 32 |
| 3 | 2 | 486 | 440 | 2 | 32 |
| 4 | 2 | 487 | 441 | 2 | 32 |

Table 6 shows an example of a sinusoid track structure of a first set for extracting first 10 pulses out of 20 pulses in the sinusoidal mode frame of layer 8.

TABLE 6

| Track | Number of sinusoids | Starting position | Position step size | Length |
|---|---|---|---|---|
| 0 | 2 | 280 | 2 | 32 |
| 1 | 2 | 281 | 2 | 32 |
| 2 | 2 | 282 | 3 | 32 |
| 3 | 2 | 440 | 2 | 32 |
| 4 | 2 | 441 | 2 | 32 |

Table 7 shows an example of a sinusoid track structure of a second set for extracting second 10 pulses out of the 20 pulses in the sinusoidal mode frame of layer 8.

TABLE 7

| Track | Number of sinusoids | Starting position | Position step size | Length |
|---|---|---|---|---|
| 0 | 2 | 376 | 2 | 32 |
| 1 | 2 | 377 | 2 | 32 |
| 2 | 2 | 440 | 3 | 32 |
| 3 | 2 | 441 | 3 | 32 |
| 4 | 2 | 442 | 3 | 32 |

From the tables showing the examples of the sinusoid track structure, it can be seen that two sinusoids are generally encoded for each track. For example, in the example of Table 4 relevant to layer 7, 32 positions, that is, 5 bits, are allocated to each sinusoid so as to encode two sinusoids for each track of 5 tracks. When 5 bits are used, all position information is expressed with $2^5=32$ retrieval spaces and it is thus difficult to transmit additional information other than the position information.

In an existing sinusoidal mode, two indices are transmitted for 32 retrieval spaces and 5 bits are used for transmission of the indices. That is, in the sinusoidal mode, position information, sign information, and amplitude information of a first sinusoid which is a sinusoid having the largest absolute value are extracted through detection of the first sinusoid, a second sinusoid which is a sinusoid having the second largest absolute value is retrieved, and position information, sign information, and amplitude information thereof are extracted. When detecting the second sinusoid, the amplitude of the first sinusoid is set to 0 so as not to detect the detected first sinusoid again.

Since the amplitude of the first sinusoid is set to 0 at the time of detecting the second sinusoid, the same position as the position of the first sinusoid is not selected in the step of detecting the second sinusoid.

Figure 7:
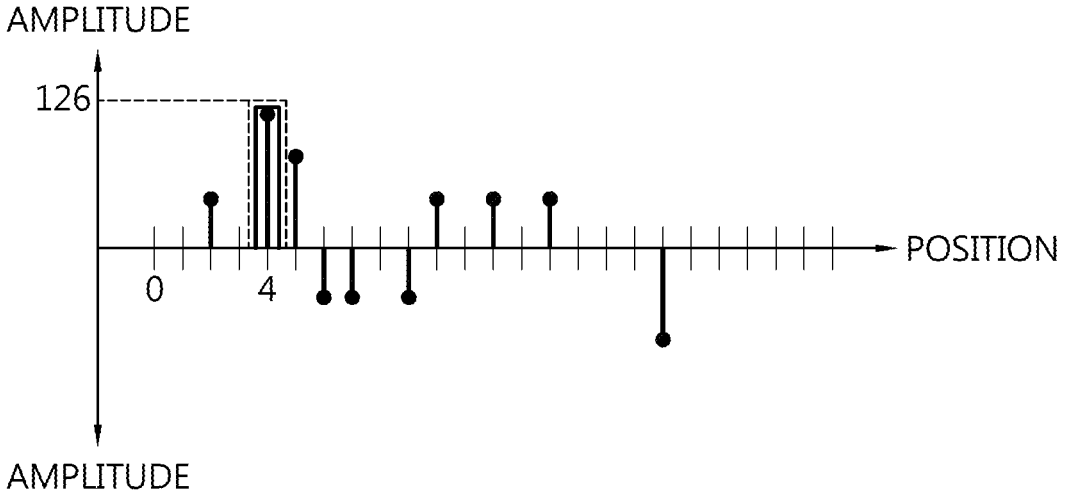
FIG. 7 is a diagram schematically illustrating a method of selecting a first sinusoid and a second sinusoid.

FIG. 7 is a diagram schematically illustrating the method of selecting the first sinusoid and the second sinusoid. In the example illustrated din FIG. 7, the amplitude of the pulse present at position 4 is 126 which is the largest. Therefore, the pulse at position 4 is retrieved as the first sinusoid and the position, sign, and amplitude information thereof are extracted.

When the amplitude of the detected first sinusoid is not set to 0 at the time of detecting the second sinusoid, the pulse of at position 4 may be retrieved as the second sinusoid. Accordingly, in the sinusoidal mode, the amplitude of the first sinusoid is set to 0 and then the second sinusoid is retrieved.

Therefore, the number of combinations in which the positions of two pulses can be expressed at the positions of the pulses using 5 bits is $2^5 \times 2^5 = 1024$, but the number of cases which are not used for retrieving the second sinusoid is present in the sinusoidal mode. Accordingly, the number of combinations which can be actually used in the sinusoidal mode is $2^5 \times (2^5 - 1) = 992$.

As a result, 10 bits are used but the 32 cases which are not used is present therein. In other words, in the example illustrated in FIG. 7, the case where the sinusoid at position 4 is selected in the step of retrieving the first sinusoid and the sinusoid at position 4 is selected in the step of retrieving the second sinusoid is not used, but is present as a case allocated to the transmission bits.

Therefore, the cases which are present but not used are defined to indicate new combinations of sinusoids expressing features of a voice signal and the information indicating the newly-defined combinations of sinusoids may be transmitted.

For example, when the transmitted information indicating positions of two sinusoids duplicatively indicates the position of the first sinusoid or duplicatively indicates the position of the second sinusoid, the information may be defined to indicate the duplicatively-indicated sinusoid and the sinusoid adjacent to the duplicatively-indicated sinusoid. In the example illustrated in FIG. 7, when the information indicating the position of a sinusoid duplicatively indicates position 4, the information may be defined to indicate the sinusoid at position 4 and the sinusoid at position 5.

In this case, two sinusoids adjacent to the indicated sinusoid along with the indicated sinusoid are extracted as the sinusoids to be encoded. The transmitted information may be any one of (1) the duplicatively-indicated sinusoid and (2) two adjacent sinusoids. The decoder may analyze that the information on adjacent sinusoids in the received information is the same before and after the duplicatively-indicated position of the sinusoid, and may reconstruct the corresponding sinusoids.

For example, when the position indices indicating the positions of two sinusoids (pulses) are equal to each other, for example, when two position indices are 15, the decoder may determine that the sinusoid with a position index of 14 or a position index of 16 along with the sinusoid with a position index of 15 is extracted as the sinusoids to be encoded. Therefore, the decoder may reconstruct the sinusoid with the position index of 15 on the basis of the received information and may reconstruct the sinusoids with the position index of 14 and the position index of 16 on the basis of the same information.

Therefore, referring to Tables 2 to 7, when two sinusoids are transmitted for each track, that is, as for predetermined tracks (track 0 to track 3 in the example illustrated in FIG. 6) of a frame to which the sinusoidal mode is applied in layer 6, tracks of a frame to which the sinusoidal mode is applied in layer 7, tracks of a frame to which the generic mode is applied and a frame to which the sinusoidal mode is applied in layer 8, and tracks of a frame to which the generic mode is applied in layer 6 and to which the additional sinusoidal mode is applied in layer 8, two sinusoids (for example, two adjacent sinusoids) reflecting characteristics of an input voice signal well may be selected instead of the largest sinusoids. The information of the selected two sinusoids may be transmitted when the same sinusoid position is duplicatively indicated.

When information of two adjacent sinusoids is transmitted, the method of transmitting the information is the same as the method of transmitting information of two largest sinusoids. For example, information indicating the positions of the sinusoids, information indicating the amplitudes of the sinusoids, and information indicating the signs of the sinusoids are transmitted. Here, the "sinusoid" means an MDCT coefficient of a sinusoid as described above, and the position of a sinusoid may be the wave number corresponding to the sinusoid (MDCT coefficient). The signs of two adjacent sinusoids may be transmitted using 1 bit. In order to transmit information indicating the signs of two adjacent sinusoids using 1 bit, a method of transmitting information only when the signs of two adjacent sinusoids are equal to each other may be used.

In the present invention, in encoding position information, the same transmission bits are used but the number of components to be encoded, that is, the number of information pieces to be transmitted, increases in comparison with the existing sinusoidal mode by causing additional information to correspond to the number of cases which are not used for transmission. Accordingly, it is possible to lower quantization error without using an additional bit. It may be possible to prevent an increase in quantization error and to improve sound quality by adaptively using (1) the method of transmitting information of two largest sinusoids and (2) the method of selectively transmitting more efficient information out of information of two largest sinusoids and information of two adjacent sinusoids in consideration of noise based on quantization.

The method of transmitting more efficient information out of the information of two largest sinusoids and the information of two adjacent sinusoids will be described below with reference to the accompanying drawings.

When information of two sinusoids in a track is transmitted, it is assumed that a first sinusoid and a second sinusoid are detected as two largest sinusoids through retrieval. The first sinusoid is a sinusoid having the maximum amplitude in the track and the second sinusoid is a sinusoid having the second maximum amplitude in the track.

In the present invention, any one of (1) information of the first sinusoid and the second sinusoid, (2) information of the first sinusoid and sinusoids adjacent to the first sinusoid, and (3) information of the second sinusoid and sinusoids adjacent to the second sinusoid is selected and transmitted.

When information of two adjacent sinusoids is transmitted (that is, cases of (2) and (3)), information of two indices indicating the same sinusoid position is transmitted. For example, in the case of (2), two indices indicating the position of the first sinusoid may be transmitted. In the case of (3), two indices indicating the position of the second sinusoid may be transmitted.

Which of (1) information of the first sinusoid and the second sinusoid, (2) information of the first sinusoid and sinusoids adjacent to the first sinusoid, and (3) information of the second sinusoid and sinusoids adjacent to the second sinusoid to transmit may be determined by comparison of means square errors (MSE) of the cases.

When the position of the n-th largest sinusoid in a track is defined as $pos^n_{MAX}$, the position of the first sinusoid can be expressed by $pos^1_{MAX}$ and the position of the second sinusoid can be expressed by $pos^2_{MAX}$. The positions of two sinusoids adjacent to the first sinusoid are $pos^1_{MAX}-1$ and $pos^1_{MAX}+1$, and the positions of two sinusoids adjacent to the second sinusoid are $pos^2_{MAX}-1$ and $pos^2_{MAX}+1$.

Therefore, the MSE $MSE^1_{MAX}$ of the first sinusoid, the MSE $MSE^2_{MAX}$ of the second sinusoid, the average MSE $MSE^1_{adjacent}$, of two sinusoids adjacent to the first sinusoid, and the average MSE $MSE^2_{adjacent}$, of two sinusoids adjacent to the second sinusoid are expressed, for example, by Expression 5.

transmitted in the sinusoidal mode according to the present invention. The method illustrated in FIG. 8 may be performed by the sinusoidal mode unit and the additional sinusoidal mode unit of the encoder illustrated in FIG. 1. In the description with reference to FIG. 8, a "sinusoid" may mean the MDCT coefficient of the sinusoid as described above.

Figure 8:
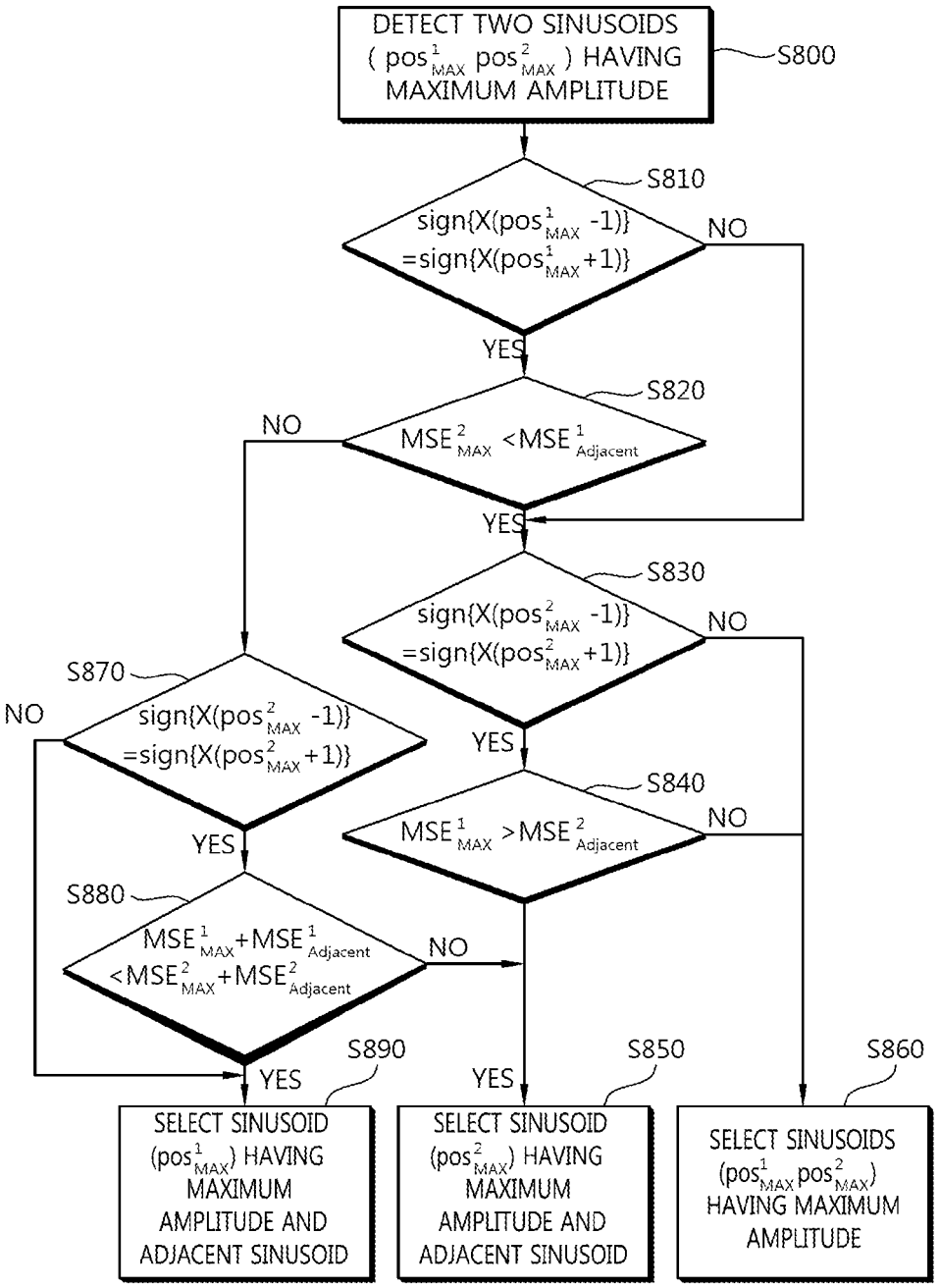
FIG. 8 is a flowchart schematically illustrating an example of a method of determining information to be transmitted in a sinusoidal mode according to the present invention.

Referring to FIG. 8, two sinusoids (a first sinusoid and a second sinusoid) having the maximum amplitudes are detected from a track from which sinusoidal information will be transmitted through retrieval (S800). As described above, it is assumed that the detected position of the first sinusoid is $pos^1_{MAX}$ and the detected position of the second sinusoid is $pos^2_{MAX}$. Then, the two sinusoids having the maximum amplitudes can be detected using the value of D(k) detected using Expression 1.

Subsequently, it is determined whether the signs of two sinusoids adjacent to the first sinusoid out of the detected sinusoids are equal to each other (S810). When the information of the two sinusoids is transmitted, only the information of the sinusoid to be first transmitted in the information on the signs is transmitted using 1 bit. Therefore, ⟨Expression 5⟩

$$MSE^1_{MAX} = \sqrt{\left(\left(X(pos^1_{MAX}) - \hat{X}(pos^1_{MAX})\right)\right)^2}$$

$$MSE^2_{MAX} = \sqrt{\left(\left(X(pos^2_{MAX}) - \hat{X}(pos^2_{MAX})\right)\right)^2}$$

$$MSE^1_{Adjacent} = \frac{\sqrt{\left(\left(X(pos^1_{MAX}-1) - \hat{X}(pos^1_{MAX}-1)\right)\right)^2} + \sqrt{\left(\begin{matrix}(X(pos^1_{MAX}+1) - \\ \hat{X}(pos^1_{MAX}+1)\end{matrix}\right)^2}}{2}$$

$$MSE^2_{Adjacent} = \frac{\sqrt{\left(\left(X(pos^2_{MAX}-1) - \hat{X}(pos^2_{MAX}-1)\right)\right)^2} + \sqrt{\left(\begin{matrix}(X(pos^2_{MAX}+1) - \\ \hat{X}(pos^2_{MAX}+1)\end{matrix}\right)^2}}{2}$$

In Expression 5, X(k) represents the MDCT coefficient of the k-th sinusoidal component (sinusoid with a wave number of k) constituting an original signal, and $\hat{X}(k)$ represents the quantized MDCT coefficient of the k-th sinusoidal component.

The MDCT coefficient of the first sinusoid can be expressed by $X(pos^1_{MAX})$ and the MDCT coefficient of the second sinusoid can be expressed by $X(pos^2_{MAX})$. Therefore, the MDCT coefficients of two sinusoids adjacent to the first sinusoid can be expressed by $X(pos^1_{MAX}-1)$ and $X(pos^1_{MAX}+1)$ and the MDCT coefficients of two sinusoids adjacent to the second sinusoid can be expressed by $X(pos^2_{MAX}-1)$ and $X(pos^2_{MAX}+1)$.

In the present invention, the MSEs of (1) information of the first sinusoid and the second sinusoid, (2) information of the first sinusoid and sinusoids adjacent to the first sinusoid, and (3) information of the second sinusoid and sinusoids adjacent to the second sinusoid may be compared and the information having the smallest MSE out of (1) to (3) may be transmitted.

In order to use the same transmission bits as in the case of (1) to transmit information of two adjacent sinusoids, the cases of (2) and (3) may be limited to only the case where the signs of two sinusoids are equal to each other. Therefore, similarly to the case of (1) in which the signs of the sinusoids are transmitted using 1 bit, the signs of the sinusoids may be indicated using 1 bit in the cases of (2) and (3).

FIG. 8 is a flowchart schematically illustrating an example of the method of determining information to be when the information of two adjacent sinusoids is transmitted instead of transmitting the information of two largest sinusoids, transmitting of the information of two adjacent sinusoids may be permitted only when the signs of two adjacent sinusoids are equal to each other. Accordingly, the information on the signs can be transmitted using 1 bit similarly to the case where the information of the two largest sinusoids is transmitted.

When the signs of two sinusoids adjacent to the first sinusoid are equal to each other, the Mean Square Error (MSE) of the second sinusoid and the average MSE of the sinusoids adjacent to the first sinusoid are compared (S820). The MSE of the second sinusoid and the average MSE of the sinusoids adjacent to the first sinusoid are the same as expressed by Expression 5.

When the MSE of the second sinusoid is smaller than the average MSE of the sinusoids adjacent to the first sinusoid, the information of the sinusoids adjacent to the first sinusoid is excluded from the information to be transmitted. Therefore, it is determined whether to transmit the information of the second sinusoid and the first sinusoid or whether to transmit the information of the second sinusoid and the sinusoids adjacent to the second sinusoid.

When it is determined in step S810 that the signals of two sinusoids adjacent to the first sinusoid are not equal to each other, the information of two sinusoids adjacent to the first sinusoid is excluded from the information to be transmitted and thus it is determined whether to transmit the information of the second sinusoid and the first sinusoid or whether to transmit the information of the second sinusoid and the sinusoids adjacent to the second sinusoid.

When the MSE of the second sinusoid is larger than the average MSE of the sinusoids adjacent to the first sinusoid, the information of the second sinusoid and the information of the first sinusoid are excluded from the information to be transmitted. Therefore, it is determined whether to transmit the information of the first sinusoid and the sinusoids adjacent to the first sinusoid or whether to transmit the information of the second sinusoid and the sinusoids adjacent to the second sinusoid.

When it is determined in step S820 that the MSE of the second sinusoid is smaller than the average MSE of the sinusoids adjacent to the first sinusoid or that the signs of two sinusoids adjacent to the first sinusoid are not equal to each other, it is determined whether the signs of two sinusoids adjacent to the second sinusoid are equal to each other (S830).

When the signs of two sinusoids adjacent to the second sinusoid are equal to each other, the MSE of the first sinusoid and the average MSE of the sinusoids adjacent to the second sinusoid are compared (S840).

When the MSE of the first sinusoid is larger than the average MSE of the sinusoids adjacent to the second sinusoid, the information of the second sinusoid and the sinusoids adjacent to the second sinusoid is transmitted (S850). At this time, the information of one of two sinusoids adjacent to the second sinusoid along with the information of the second sinusoid is transmitted. For example, the position information duplicatively indicating the position of the second sinusoid, the amplitude information of the second sinusoid and the sinusoids adjacent to the second sinusoid, and sign information of the sinusoids adjacent to the second sinusoid are encoded and transmitted.

The decoder may induce the second sinusoid and the sinusoids adjacent to the second sinusoid on the basis of the information of the received sinusoids. The sinusoids adjacent to the second sinusoid may be included as sinusoids having the same amplitude and the same sign at two positions (before and after the second sinusoid) adjacent to the second sinusoid.

When the MSE of the first sinusoid is smaller than the average MSE of the sinusoids adjacent to the second sinusoid, the information of the first sinusoid and the second sinusoid is transmitted (S860). When it is determined in step S830 that the signs of two sinusoids adjacent to the second sinusoid are not equal to each other, the information of the sinusoids adjacent to the second sinusoid is excluded from the information to be transmitted and thus the information of the first sinusoid and the second sinusoid is transmitted (S860).

On the other hand, when it is determined in step S820 that the MSE of the second sinusoid is larger than the average MSE of the sinusoids adjacent to the first sinusoid, it is determined whether the signs of two sinusoids adjacent to the first sinusoid are equal to each other (S870).

When the signs of two sinusoids adjacent to the first sinusoid are equal to each other, the MSE of the first sinusoid and the sinusoids adjacent to the first sinusoid and the MSE of the second sinusoid and the sinusoids adjacent to the second sinusoid are compared (S880). The MSE of the first sinusoid and the sinusoids adjacent to the first sinusoid means the average MSE of the MSE of the first sinusoid and the MSEs of the sinusoids adjacent to the first sinusoid. The MSE of the second sinusoid and the sinusoids adjacent to the second sinusoid means the average MSE of the MSE of the second sinusoid and the MSEs of the sinusoids adjacent to the second sinusoid.

When the MSE of the first sinusoid and the sinusoids adjacent to the first sinusoid is smaller than the MSE of the second sinusoid and the sinusoids adjacent to the second sinusoid, the information of the first sinusoid and the sinusoids adjacent to the first sinusoid is transmitted (S890). At this time, the information of one of two sinusoids adjacent to the first sinusoid along with the information of the first sinusoid is transmitted. For example, the position information duplicatively indicating the position of the first sinusoid, the amplitude information of the first sinusoid and the sinusoid adjacent to the first sinusoid, and the sign information of the sinusoids adjacent to the first sinusoid are encoded and transmitted.

The decoder may induce the first sinusoid and the sinusoids adjacent to the first sinusoid on the basis of the received information of the sinusoids. The sinusoids adjacent to the first sinusoid may be induced as sinusoids having the same amplitude and the same sign at two positions (before and after the first sinusoid) adjacent to the first sinusoid.

When the MSE of the first sinusoid and the sinusoids adjacent to the first sinusoid is larger than the MSE of the second sinusoid and the sinusoids adjacent to the second sinusoid, the information of the second sinusoid and the sinusoids adjacent to the second sinusoid is transmitted (S850). At this time, the information of one of two sinusoids adjacent to the second sinusoid along with the information of the second sinusoid is transmitted. As described above, the decoder may induce the second sinusoid and the sinusoids adjacent to the second sinusoid.

The determination condition $MSE^2_{MAX}<MSE^1_{adjacent}$ of S820 is equivalent to $MSE^1_{MAX}+MSE^2_{MAX}<MSE^1_{MAX}+MSE^1_{adjacent}$. The determination condition $MSE^1_{MAX}>MSE^2_{adjacent}$ of S840 is equivalent to $MSE^1_{MAX}+MSE^2_{MAX}>MSE^2_{MAX}+MSE^2_{adjacent}$.

Accordingly, the information having the smallest MSE out of (1) the information of the first sinusoid and the second sinusoid, (2) the information of the first sinusoid and sinusoids adjacent to the first sinusoid, and (3) the information of the second sinusoid and sinusoids adjacent to the second sinusoid is transmitted.

At this time, the information to be transmitted includes (i) the information of the first sinusoid and the second sinusoid, (ii) the information of the first sinusoid and sinusoids adjacent to the first sinusoid when the signs of two sinusoids adjacent to the first sinusoid are equal to each other, and (iii) the information of the second sinusoid and sinusoids adjacent to the second sinusoid when the signs of two sinusoids adjacent to the second sinusoid are equal to each other.

Table 8 simply shows the information to be transmitted in the example illustrated in FIG. 8.

TABLE 8

| First sign | Second sign | MSE 1&2 VS MSE 1&ADJ | MSE 1&2 VS MSE 2&ADJ | MSE 1 &ADJ VS MSE 2&ADJ | Information to be transmitted |
|---|---|---|---|---|---|
| Equal | Equal | MSE 1&2 | MSE 1&2 | | First sinusoid and second sinusoid |
| Equal | NOT Equal | MSE 1&2 | | | |
| NOT Equal | Equal | | MSE 1&2 | | |
| NOT Equal | NOT Equal | | | | |

TABLE 8-continued

| First sign | Second sign | MSE 1&2 VS MSE 1&ADJ | MSE 1&2 VS MSE 2&ADJ | MSE 1 &ADJ VS MSE 2&ADJ | Information to be transmitted |
|---|---|---|---|---|---|
| Equal | Equal | MSE 1&ADJ | | MSE 1&ADJ | First sinusoid and the sinusoids adjacent |
| Equal | NOT Equal | MSE 1&ADJ | | | |
| Equal | Equal | | MSE 2&ADJ | MSE 2&ADJ | Second sinusoid and the sinusoids adjacent |
| NOT Equal | Equal | | MSE 2&ADJ | | |

In Table 8, the "first sign" represents whether the signs of two sinusoids adjacent to the first sinusoid are equal to each other. In Table 8, the "second sign" represents whether the signs of two sinusoids adjacent to the second sinusoid are equal to each other. [0242] In Table 8, "MSE 1&2 VS MSE 1&ADJ" represents which of the MSE when the information of the first sinusoid and the second sinusoid is transmitted and the MSE when the information of the first sinusoid and the sinusoid adjacent to the first sinusoid is transmitted is smaller.

In Table 8, "MSE 1&2 VS MSE 2&ADJ" represents which of the MSE when the information of the first sinusoid and the second sinusoid is transmitted and the MSE when the information of the second sinusoid and the sinusoid adjacent to the second sinusoid is transmitted is smaller.

In Table 8, "MSE 1&ADJ VS MSE 2&ADJ" represents which of the MSE when the information of the first sinusoid and the sinusoid adjacent to the first sinusoid is transmitted and the MSE when the information of the second sinusoid and the sinusoid adjacent to the second sinusoid is transmitted is smaller.

In the present invention, new information on the cases which are not used in the method of simply detecting and transmitting two largest sinusoids in a track is additionally used. Accordingly, the same bitstream structure as the bitstream when only the information of two largest sinusoids is transmitted can be used.

Table 9 schematically shows a bitstream structure used in the present invention.

TABLE 9

| Parameter | The number of bits per transmitted information | Total number of bits |
|---|---|---|
| Sinusoidal positions | 5 + 5 + 5 + 5 + 5 + 5 + 5 + 5 + 5 + 5 | 50 |
| Sinusoidal signs | 1 + 1 + 1 + 1 + 1 | 5 |
| Sinusoidal amplitude | 8 + 8 + 8 | 24 |

In the example illustrated in FIG. 8, the method of comparing the MSE of the sinusoids (the first sinusoid and the second sinusoid) detected to have the maximum amplitude with the average MSE of the adjacent sinusoids and selecting the information having the smaller MSE is used as the method of selecting the information to be transmitted. Accordingly, when more effective information is present than the information of the largest sinusoids (information having the smaller MSE is present), it is possible to reduce quantization noise by transmitting the more effective information without using an additional bit.

For example, when the conditional expression shown in Table 10 is satisfied, two sinusoids detected to be the largest sinusoids are selected and the information of the selected two sinusoids is transmitted. On the contrary, when the conditional expression shown in Table 10 is not satisfied, any one of two sinusoids detected to be the largest sinusoids and the sinusoid adjacent thereto are selected and the information of the selected sinusoids is transmitted.

TABLE 10

If
$MSE^2_{MAX} < MSE^1_{adjacent}$
select $X(pos^1_{MAX})$ and $X(pos^2_{MAX})$
else
select $X(pos^1_{MAX}-1)$, $X(pos^1_{MAX})$ and $X(pos^1_{MAX}+1)$ The example shown in Table 10 shows a part of the method described with reference to FIG. 8, that is, a method of selecting which of the information of two largest sinusoids and the information of one largest sinusoid and the sinusoid adjacent thereto to transmit.

Figure 9:
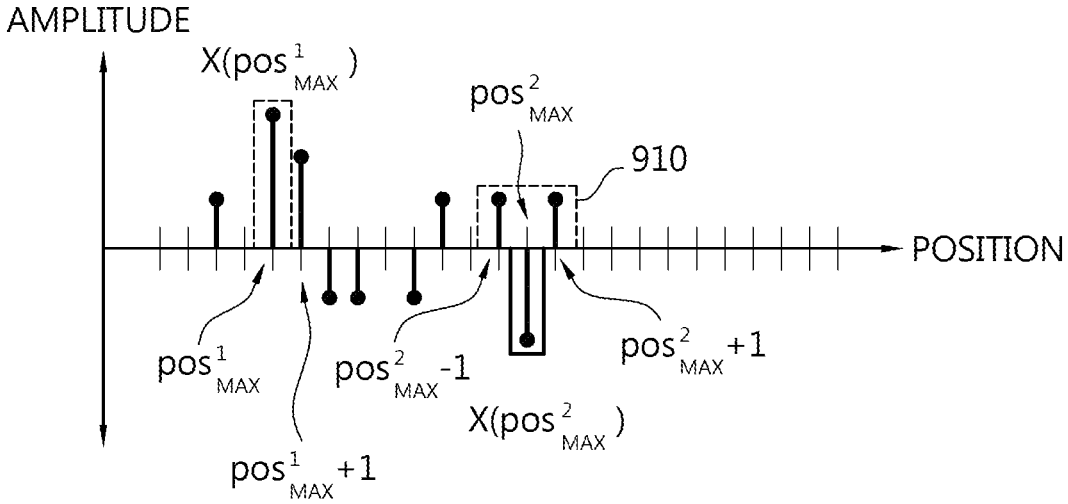
FIG. 9 is a diagram illustrating an example of a case in which signs of sinusoids adjacent to only one sinusoid out of two sinusoids having the maximum amplitudes.

FIG. 9 is a diagram illustrating an example where the signs of two sinusoids adjacent to only one of two sinusoids having the maximum amplitude are equal to each other.

Referring to FIG. 9, the sinusoids having the same sign are not present at the positions $pos^1_{MAX}-1$ and $pos^1_{MAX}+1$ adjacent to the first sinusoid located at the position $pos^1_{MAX}$. On the contrary, two sinusoids located at the positions $pos^2_{MAX}-1$ and $pos^2_{MAX}+1$ adjacent to the second sinusoid located at the position $pos^2_{MAX}$ have the same sign.

Therefore, the second sinusoid is selected as a sinusoid to be encoded and it is determined whether to encode the first sinusoid or the adjacent sinusoids 910 along with the second sinusoid. It may be determined whether to encode the first sinusoid or the adjacent sinusoids 910 using the determination method shown in Table 9.

Figure 10:
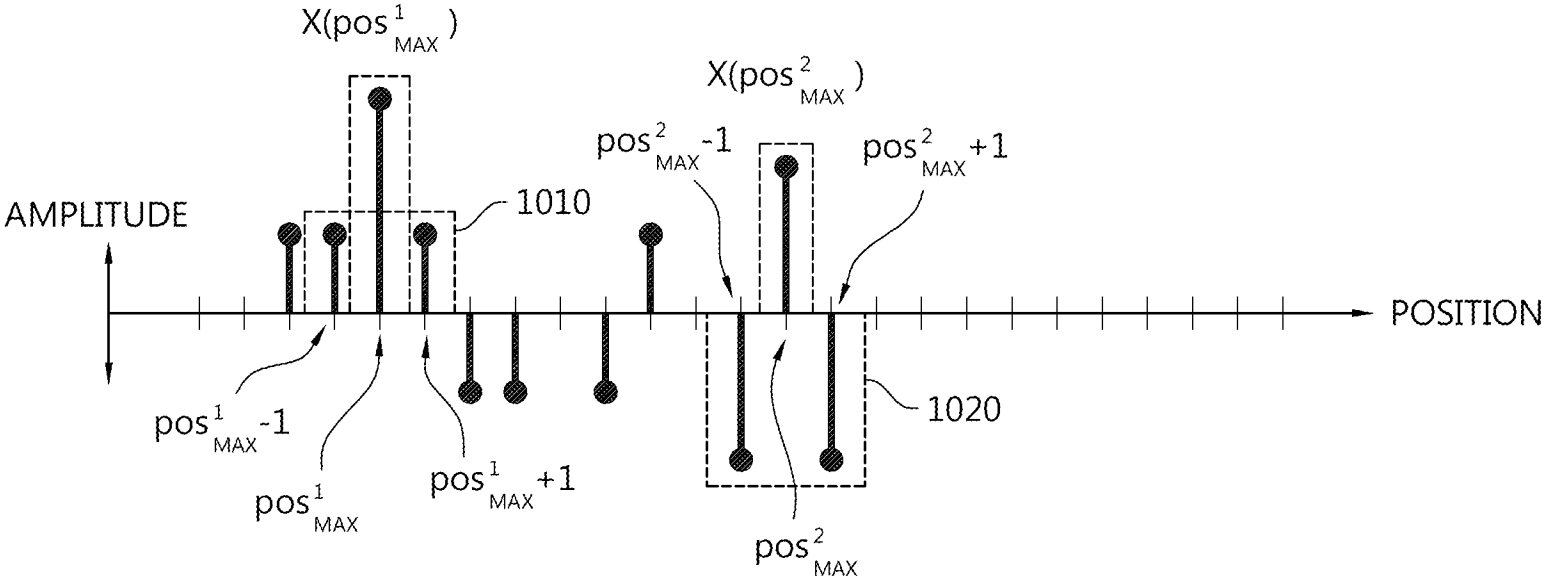
FIG. 10 is a diagram schematically illustrating a method of selecting information to be transmitted in a case in which signs of two sinusoids adjacent to each of two sinusoids having the maximum amplitudes are equal to each other.

FIG. 10 is a diagram schematically illustrating a method of selecting information to be transmitted when the signs of two sinusoids adjacent to each of the two largest sinusoids are equal to each other.

Referring to FIG. 10, the signs of two sinusoids $X(pos^1_{MAX}-1)$ and $X(pos^1_{MAX}+1)$ adjacent to the first sinusoid $X(pos^1_{MAX})$ are equal to each other. The signs of two sinusoids $X(pos^2_{MAX}-1)$ and $X(pos^2_{MAX}+1)$ adjacent to the second sinusoid $X(pos^2_{MAX})$ are also equal to each other.

Therefore, it should be determined which of (1) the information of the first sinusoid and the second sinusoid, (2) the information of the first sinusoid and sinusoids (1010) adjacent to the first sinusoid, and (3) the information of the second sinusoid and sinusoids (1020) adjacent to the second sinusoid to transmit. In this case, the case where the MSE is minimized using Expression 6 by comparing the MSEs. The information having the smallest MSE out of the cases of (1) to (3) is determined as the information to be transmitted.

$$\mathrm{Min}(\{MSE^1_{MAX}+\mathrm{Min}(MSE^2_{MAX},MSE^1_{Adjacent})\},\ \{MSE^2_{MAX}+MSE^2_{Adjacent}\}) \quad \text{<Expression 6>}$$

While the method of selecting the information to be transmitted using the MSE has been described hitherto, the present invention is not limited to the method.

For example, the information to be transmitted may be selected in consideration of the amplitudes of sinusoids (amplitude of MDCT coefficients of sinusoidal components) instead of the MSE. At this time, the amplitude of a specific sinusoid may be determined to be the magnitude of the sum of residual signals. The sum of residual signals (D) can be defined as a value obtained by subtracting the quantized value of the MDCT coefficient corresponding to the specific sinusoid from the sum of all the MDSCT coefficients of the sinusoids in a target track.

Expression 7 shows the average of the sum of residual signals of two largest sinusoids (the first sinusoid and the second sinusoid) retrieved from the target track and the sum of residual signals of the sinusoids adjacent to the first sinusoid.

$$D^1_{MAX} = \text{sum}\{|\tilde{X}(k) - \hat{X}(pos^1_{MAX})|\} \quad \langle\text{Expression 7}\rangle$$

$$D^2_{MAX} = \text{sum}\{|\tilde{X}(k) - \hat{X}(pos^2_{MAX})|\}$$

$$D^1_{Adjacent} = \text{sum}\left\{\frac{|\tilde{X}(k) - \hat{X}(pos^1_{MAX} - 1)| + |\tilde{X}(k) - \hat{X}(pos^1_{MAX} + 1)|}{2}\right\}$$

$$D^2_{Adjacent} = \text{sum}\left\{\frac{|\tilde{X}(k) - \hat{X}(pos^2_{MAX} - 1)| + |\tilde{X}(k) - \hat{X}(pos^2_{MAX} + 1)|}{2}\right\}$$

In Expression 7, $\tilde{X}(k)$ represents the k-th MDCT coefficient of the MDCT coefficients in the current track out of the original MDCT coefficients X(k) and $\hat{X}(k)$ represents the k-th quantized MDCT coefficient of the MDCT coefficients in the current track.

$pos^n_{MAX}$ represents the position of the n-th largest sinusoid (the MDCT coefficient of the sinusoidal component) in the track as described above.

$D^n_{MAX}$ represents the sum of residual signals of the n-th sinusoid which is the sum of the residual coefficients other than the MDCT coefficient of the n-th sinusoid out of the MDCT coefficients of the sinusoids in the sinusoidal mode.

$D^n_{Adjacent}$ represents the average of the sums of the residual signals of two sinusoids adjacent to the n-th sinusoid. That is, $D^n_{Adjacent}$ corresponds to a value obtained by adding the sum of the residual coefficients other than the MDCT coefficient of the (n−1)-th sinusoid out of the MDCT coefficients of the sinusoids in the sinusoidal mode and the sum of the residual coefficients other than the MDCT coefficient of the (n+1)-th sinusoid and dividing the addition result by 2.

Figure 11:
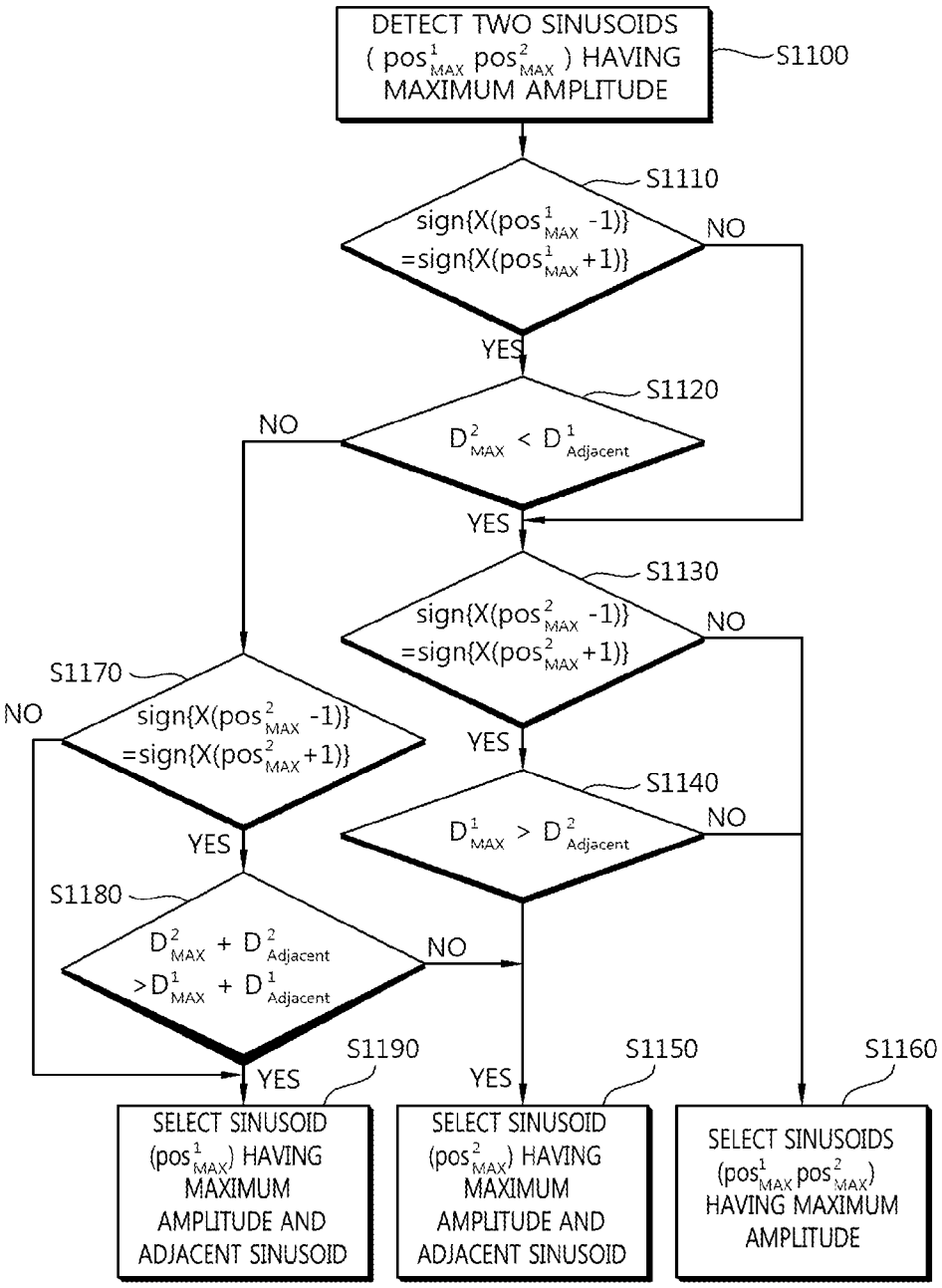
FIG. 11 is a flowchart schematically illustrating an example of a method of determining information to be transmitted using absolute values of MDCT coefficients before quantization.

FIG. 11 is a flowchart schematically illustrating an example of the method of determining information to be transmitted using the absolute values of the MDCT coefficients before quantization instead of the MSE. In the description with reference to FIG. 11, a "sinusoid" may mean the MDCT coefficient of the sinusoid as described above.

Referring to FIG. 11, two sinusoids (a first sinusoid and a second sinusoid) having the maximum amplitudes are detected from a track from which sinusoidal information will be transmitted through retrieval (S1100). As described above, it is assumed that the detected position of the first sinusoid is $pos^1_{MAX}$ and the detected position of the second sinusoid is $pos^1_{MAX}$. Then, the two sinusoids having the maximum amplitudes can be detected using the value of D(k) detected using Expression 1.

Subsequently, it is determined whether the signs of two sinusoids adjacent to the first sinusoid out of the detected sinusoids are equal to each other (S1110). When the information of two adjacent sinusoids is transmitted instead of transmitting the information of two largest sinusoids, transmitting of the information of two adjacent sinusoids may be permitted only when the signs of two adjacent sinusoids are equal to each other. Accordingly, the information on the signs can be transmitted using 1 bit similarly to the case where the information of the two largest sinusoids is transmitted.

When the signs of two sinusoids adjacent to the first sinusoid are equal to each other, $D^2_{MAX}$ of the second sinusoid and $D^1_{Adjacent}$ of the sinusoids adjacent to the first sinusoid are compared (S1120). $D^2_{MAX}$ of the second sinusoid and $D^1_{Adjacent}$ of the sinusoids adjacent to the first sinusoid are the same as expressed by Expression 7.

In the example illustrated in FIG. 11, information of sinusoids having the larger amplitudes out of information pieces to be transmitted and to be compared is preferentially transmitted. Therefore, the information having the smaller value may be selected in the example illustrated in FIG. 11 in which the sums of residual coefficients or the average sums of residual coefficients are compared.

When $D^2_{MAX}$ of the second sinusoid is smaller than $D^1_{Adjacent}$ of the sinusoids adjacent to the first sinusoid, the information of the sinusoids adjacent to the first sinusoid is excluded from the information to be transmitted. Therefore, it is determined whether to transmit the information of the second sinusoid and the first sinusoid or whether to transmit the information of the second sinusoid and the sinusoids adjacent to the second sinusoid.

When it is determined in step S1110 that the signals of two sinusoids adjacent to the first sinusoid are not equal to each other, the information of two sinusoids adjacent to the first sinusoid is excluded from the information to be transmitted and thus it is determined whether to transmit the information of the second sinusoid and the first sinusoid or whether to transmit the information of the second sinusoid and the sinusoids adjacent to the second sinusoid.

When $D^2_{MAX}$ of the second sinusoid is larger than $D^1_{Adjacent}$ of the sinusoids adjacent to the first sinusoid, the information of the second sinusoid and the information of the first sinusoid are excluded from the information to be transmitted. Therefore, it is determined whether to transmit the information of the first sinusoid and the sinusoids adjacent to the first sinusoid or whether to transmit the information of the second sinusoid and the sinusoids adjacent to the second sinusoid.

When it is determined in step S1120 that $D^2_{MAX}$ of the second sinusoid is smaller than $D^1_{Adjacent}$ of the sinusoids adjacent to the first sinusoid or that the signs of two sinusoids adjacent to the first sinusoid are not equal to each other, it is determined whether the signs of two sinusoids adjacent to the second sinusoid are equal to each other (S1130).

When the signs of two sinusoids adjacent to the second sinusoid are equal to each other, $D^1_{MAX}$ of the first sinusoid and $D^2_{Adjacent}$ of the sinusoids adjacent to the second sinusoid are compared (S1140).

When $D^1_{MAX}$ of the first sinusoid is larger than $D^2_{Adjacent}$ of the sinusoids adjacent to the second sinusoid, the information of the second sinusoid and the sinusoids adjacent to the second sinusoid is transmitted (S1150). At this time, the information of one of two sinusoids adjacent to the second sinusoid along with the information of the second sinusoid is transmitted. For example, the position information duplicatively indicating the position of the second sinusoid, the amplitude information of the second sinusoid and the sinusoids adjacent to the second sinusoid, and sign information of the sinusoids adjacent to the second sinusoid are encoded and transmitted.

The decoder may induce the second sinusoid and the sinusoids adjacent to the second sinusoid on the basis of the information of the received sinusoids. The sinusoids adjacent to the second sinusoid may be included as sinusoids having the same amplitude and the same sign at two positions (before and after the second sinusoid) adjacent to the second sinusoid.

When $D^1_{MAX}$ of the first sinusoid is smaller than $D^2_{Adjacent}$ of the sinusoids adjacent to the second sinusoid, the information of the first sinusoid and the second sinusoid is transmitted (S1160). When it is determined in step S1130 that the signs of two sinusoids adjacent to the second sinusoid are not equal to each other, the information of the sinusoids adjacent to the second sinusoid is excluded from the information to be transmitted and thus the information of the first sinusoid and the second sinusoid is transmitted (S1160).

On the other hand, when it is determined in step S1120 that $D^2_{MAX}$ of the second sinusoid is larger than $D^1_{Adjacent}$ of the sinusoids adjacent to the first sinusoid, it is determined whether the signs of two sinusoids adjacent to the first sinusoid are equal to each other (S1170).

When the signs of two sinusoids adjacent to the first sinusoid are equal to each other, $D^1_{MAX}+D^1_{Adjacent}$ of the first sinusoid and the sinusoids adjacent to the first sinusoid and $D^2_{MAX}+D^2_{Adjacent}$ of the second sinusoid and the sinusoids adjacent to the second sinusoid are compared (S1180).

When $D^1_{MAX}+D^1_{Adjacent}$ of the first sinusoid and the sinusoids adjacent to the first sinusoid is smaller than $D^2_{MAX}+D^2_{Adjacent}$ of the second sinusoid and the sinusoids adjacent to the second sinusoid, the information of the first sinusoid and the sinusoids adjacent to the first sinusoid is transmitted (S1190). At this time, the information of one of two sinusoids adjacent to the first sinusoid along with the information of the first sinusoid is transmitted. For example, the position information duplicatively indicating the position of the first sinusoid, the amplitude information of the first sinusoid and the sinusoid adjacent to the first sinusoid, and the sign information of the sinusoids adjacent to the first sinusoid are encoded and transmitted.

The decoder may induce the first sinusoid and the sinusoids adjacent to the first sinusoid on the basis of the received information of the sinusoids. The sinusoids adjacent to the first sinusoid may be induced as sinusoids having the same amplitude and the same sign at two positions (before and after the first sinusoid) adjacent to the first sinusoid.

When $D^1_{MAX}+D^1_{Adjacent}$ of the first sinusoid and the sinusoids adjacent to the first sinusoid is larger than $D^2_{MAX}+D^2_{Adjacent}$ of the second sinusoid and the sinusoids adjacent to the second sinusoid, the information of the second sinusoid and the sinusoids adjacent to the second sinusoid is transmitted (S1150). At this time, the information of one of two sinusoids adjacent to the second sinusoid along with the information of the second sinusoid is transmitted. As described above, the decoder may induce the second sinusoid and the sinusoids adjacent to the second sinusoid.

The determination condition $D^2_{MAX}<D^1_{adjacent}$ of S1120 is equivalent to $D^1_{MAX}+D^2_{MAX}<D^1_{MAX}+D^1_{adjacent}$. The determination condition $D^1_{MAX}>D^2_{adjacent}$ of S1140 is equivalent to $D^1_{MAX}+D^2_{MAX}>D^2_{MAX}+D^2_{adjacent}$.

Accordingly, the information having the smallest sum of residual coefficients out of (1) the information of the first sinusoid and the second sinusoid, (2) the information of the first sinusoid and sinusoids adjacent to the first sinusoid, and (3) the information of the second sinusoid and sinusoids adjacent to the second sinusoid is transmitted.

At this time, the information to be transmitted includes (i) the information of the first sinusoid and the second sinusoid, (ii) the information of the first sinusoid and sinusoids adjacent to the first sinusoid when the signs of two sinusoids adjacent to the first sinusoid are equal to each other, and (iii) the information of the second sinusoid and sinusoids adjacent to the second sinusoid when the signs of two sinusoids adjacent to the second sinusoid are equal to each other.

Table 11 simply shows the information to be transmitted in the example illustrated in FIG. 11.

TABLE 11

| First sign | Second sign | D1 & D2 VS D1 & Dadj | D1 & D2 VS D2 & Dadj | D1 & Dadj VS D2 & Dadj | Information to be transmitted |
|---|---|---|---|---|---|
| Equal | Equal | D1 & D2 | D1 & D2 | | First sinusoid and second sinusoid |
| Equal | NOT Equal | D1 & D2 | | | |
| NOT Equal | Equal | | D1 & D2 | | |
| NOT Equal | NOT Equal | | | | |
| Equal | Equal | D1 & Dadj | | D1 & Dadj | First sinusoid and the sinusoids adjacent |
| Equal | NOT Equal | D1 & Dadj | | | |
| Equal | Equal | | D2 & Dadj | D2 & Dadj | Second sinusoid and the sinusoids adjacent |
| NOT Equal | Equal | | D2 & Dadj | | |

In Table 11, the "first sign" represents whether the signs of two sinusoids adjacent to the first sinusoid are equal to each other. In Table 11, the "second sign" represents whether the signs of two sinusoids adjacent to the second sinusoid are equal to each other. [0296] In Table 11, "D1 & D2 VS D1 & Dadj" represents which of the sum of residual coefficients ($D^1_{MAX}+D^2_{MAX}$) when the information of the first sinusoid and the second sinusoid is transmitted and the sum of residual coefficients ($D^1_{MAX}+D^1_{Adjacent}$) when the information of the first sinusoid and the sinusoid adjacent to the first sinusoid is transmitted is smaller.

In Table 11, "D1 & D2 VS D2 & Dadj" represents which of the sum of residual coefficients ($D^1_{MAX}+D^2_{MAX}$) when the information of the first sinusoid and the second sinusoid is transmitted and the sum of residual coefficients ($D^2_{MAX}+D^2_{Adjacent}$) when the information of the second sinusoid and the sinusoid adjacent to the second sinusoid is transmitted is smaller.

In Table 11, "D1 & Dadj VS D2 & Dadj" represents which of the sum of residual coefficients ($D^1_{MAX}+D^1_{Adjacent}$) when the information of the first sinusoid and the sinusoid adjacent to the first sinusoid is transmitted and the sum of residual coefficients ($D^2_{MAX}+D^2_{Adjacent}$) when the information of the second sinusoid and the sinusoid adjacent to the second sinusoid is transmitted is smaller.

In this way, when the selected information is encoded and transmitted, the decoder may reconstruct the sinusoids (the MDCT coefficients of the sinusoids) in the track on the basis of the received information.

As described above, when the information of the two largest sinusoids detected in the track is transmitted, (1) the position information of two sinusoids, (2) the amplitude information of two sinusoids, and (3) the sign information of two sinusoids are transmitted. The decoder may reconstruct the sinusoids having the indicated amplitudes and signs at the position indicated by the received information of the sinusoids.

When the information of one sinusoid of the two largest sinusoids detected in the track and the sinusoids adjacent thereto is transmitted, (1) the position information of two sinusoids, (3) the amplitude information of two sinusoids, and (3) the sign information of two sinusoids are transmitted. At this time, the position information of two sinusoids indicates the same position. The indicated position is the position of the sinusoid having the larger amplitude out of the two sinusoids.

The decoder may induce the sinusoid corresponding to the larger amplitude in the received amplitude information at the position indicated by the position information on the basis of the received information of two sinusoids. The sinusoids corresponding to the smaller amplitude in the received amplitude information may be induced at the positions (before and after or on the right and left of the position indicated by the position information) adjacent to the position indicated by the position information.

After inducing the sinusoids (MDCT coefficients) in this way, the decoder may reconstruct a voice signal through a series of processes including the process of performing the IMDCT as described with reference to FIGS. 3 and 4.

While details are written in a parenthesis for the purpose of easy understanding in some cases, it does not mean that even when the same description does not have details written in the parenthesis, the details is excluded from the description. For example, writing in a parenthesis such as "sinusoid (pulse)" and "sinusoid (MDCT coefficient)" is used, but it does not mean that the sinusoid is not a pulse or the sinusoid is not a MDCT coefficient.

According to the present invention, it is possible to enhance coding efficiency by transmitting additional information without an increase in a bit rate and to perform encoding/decoding without a change in bitstream structure, thereby guaranteeing lower compatibility.

While the methods in the above-mentioned exemplary systems have been described on the basis of the flowcharts including a series of steps or blocks, the present invention is not limited to the order of steps and a certain step may be performed in a step or an order other than described above or at the same time as described above. The above-mentioned embodiments can include various examples. For example, the embodiments may be combined and these combinations belong to the embodiments of the present invention. Therefore, it should be understood that the invention includes all other substitutions, changes, and modifications belonging to the appended claims.

The invention claimed is:

1. A voice signal encoding method performed by an encoding apparatus, comprising:

receiving, by the encoding apparatus, an input voice signal;

generating, by the encoding apparatus, modified discrete cosine transform (MDCT) coefficients of the input voice signal;

determining, by the encoding apparatus, target MDCT coefficients to be encoded out of the generated MDCT coefficients when a processing mode of the MDCT coefficients is a sinusoidal mode;

generating, by the encoding apparatus, index information indicating the target MDCT coefficients;

generating, by the encoding apparatus, a bitstream including the index information; and transmitting, by the encoding apparatus, the bitstream, wherein the index information includes a first index information and a second index information, and each of the first index information and the second index information includes position information, amplitude information, and sign information, wherein each of the first and second index information is associated with at least one of the MDCT coefficients in the target MDCT coefficients, and wherein when the target MDCT coefficients to be encoded are a first MDCT coefficient and neighboring MDCT coefficients of the first MDCT coefficient, or a second MDCT coefficient and neighboring MDCT coefficients of the second MDCT coefficient, the position information of the first index information and the position information of the second index information indicate the same position, wherein the first MDCT coefficient comprises an MDCT coefficient having a maximum amplitude and wherein the second MDCT coefficient comprises an MDCT coefficient having a second maximum amplitude less than the maximum amplitude.

2. The method of claim 1, further comprising:

estimating, by the encoding apparatus, a tonality of the MDCT coefficients based on correlation analysis between spectral peaks of current frame and past frame; and determining, by the encoding apparatus, the processing mode of the MDCT coefficients as the sinusoidal mode when a value of the estimated tonality is above a predetermined reference value, wherein the step of determining the target MDCT coefficients to be encoded includes:

determining, by the encoding apparatus, one of three combinations of the first MDCT coefficient and the second MDCT coefficient; the first MDCT coefficient and the neighboring MDCT coefficients adjacent to the first MDCT coefficient; and the second MDCT coefficient and the neighboring MDCT coefficients adjacent to the second MDCT coefficient to be the target MDCT coefficients to be encoded.

3. The method of claim 2, wherein a means square error (MSE) of the first MDCT coefficient and the second MDCT coefficient, an MSE of the first MDCT coefficient and the neighboring MDCT coefficients adjacent to the first MDCT coefficient, and an MSE of the second MDCT coefficient and the neighboring MDCT coefficients adjacent to the second MDCT coefficient are compared with each other and the combination of MDCT coefficients having a minimum MSE is determined to be the target MDCT coefficients to be encoded.

4. The method of claim 2, wherein a sum of residual coefficients of the first MDCT coefficient and the second MDCT coefficient, the a sum of residual coefficients of the first MDCT coefficient and the neighboring MDCT coefficients adjacent to the first MDCT coefficient, and a sum of residual coefficients of the second MDCT coefficient and the neighboring MDCT coefficients adjacent to the second MDCT coefficient are compared with each other and a combination of MDCT coefficients having a minimum sum of residual coefficients is determined to be the target MDCT coefficients to be encoded.

5. The method of claim 2, wherein the neighboring MDCT coefficients adjacent to the first MDCT coefficient are excluded from the target MDCT coefficients to be encoded when signs of the neighboring MDCT coefficients adjacent to the first MDCT coefficient are not equal to each other, and the neighboring MDCT coefficients adjacent to the second MDCT the coefficient are excluded from the target MDCT coefficients to be encoded when signs of the neighboring MDCT coefficients adjacent to the second MDCT coefficient are not equal to each other.

6. The method of claim 2, wherein the step of transmitting the index information includes transmitting information indicating a sign of the first MDCT coefficient to be encoded in regard to the signs of the target MDCT coefficients to be encoded.

7. The method of claim 2, wherein the position information of the first index information and the position information of the second index information indicate the position of the first MDCT coefficient when the first MDCT coefficient and the neighboring MDCT coefficients adjacent to the first MDCT coefficient are determined to be the target MDCT coefficients to be encoded, and wherein the position information of the first index information and the position information of the second index information indicate the position of the second MDCT coefficient when the second MDCT coefficient and the neighboring MDCT coefficients adjacent to the second MDCT coefficient are determined to be the target MDCT coefficients to be encoded.

8. The method of claim 1, wherein the input voice signal belong to a super-wide band.

9. A voice signal decoding method performed by a decoding apparatus, comprising:

receiving, by the decoding apparatus, a bitstream including voice information;

reconstructing, by the decoding apparatus, target MDCT coefficients based on index information included in the bitstream when a processing mode of MDCT coefficients is a sinusoidal mode, wherein the index information indicates target MDCT coefficients reconstructing, by the decoding apparatus, the MDCT coefficients based on the target MDCT coefficients;

performing, by the decoding apparatus, inverse modified discrete cosine transform (IMDCT) to the reconstructed MDCT coefficients to reconstruct the voice signal;

performing, by the decoding apparatus, post-processing on the reconstructed voice signal by filtering the reconstructed voice signal; and transmitting, by the decoding apparatus, the post-processed voice signal, wherein the index information includes a first index information and a second index information, each of the first index information and the second index information including position information, amplitude information, and sign information, and wherein when the position information of the first index information and the position information of the second index information indicate a same position, the step of reconstructing the target MDCT coefficients includes reconstructing the target MDCT coefficients at the indicated position and positions adjacent to the indicated position.

10. The method of claim 9, wherein the position information of the first index information and the position information of the second index information indicates a position of a first MDCT coefficient having a maximum amplitude in a track and a second MDCT coefficient having a second maximum amplitude in the track respectively, or duplicatively indicate the position of the first MDCT coefficient, or duplicatively indicate the position of the second MDCT coefficient.

11. The method of claim 10, wherein the first MDCT coefficient and two neighboring MDCT coefficients adjacent to the first MDCT transform coefficient are reconstructed when the position information of the first index information and the position information of the second index information indicate the same position of the first MDCT coefficient, and wherein the second MDCT transform coefficient and two neighboring MDCT coefficients adjacent to the second MDCT coefficient are reconstructed when the position information of the first index information and the position information of the second index information indicate the same position of the second MDCT coefficient.

12. The method of claim 10, wherein the first MDCT coefficient and two neighboring MDCT coefficients adjacent to the first MDCT coefficient are reconstructed to have the same amplitude when the position information of the first index information and the position information of the second index information indicate the same position of the first MDCT coefficient, and wherein the second MDCT coefficient and two neighboring MDCT coefficients adjacent to the second MDCT coefficient are reconstructed to have the same amplitude when the position information of the first index information and the position information of the second index information indicate the same position of the second MDCT coefficient.

13. The method of claim 10, wherein the first MDCT coefficient and two neighboring MDCT coefficients adjacent to the first MDCT coefficient are reconstructed to have the same sign when the position information of the first index information and the position information of the second index information indicate the first the same position of the first MDCT coefficient, and wherein the second MDCT coefficient and two neighboring MDCT coefficients adjacent to the second MDCT coefficient are reconstructed to have the same sign when the position information of the first index information and the second information of the second index information indicate the same position of the second MDCT coefficient.

14. The method of claim 9, wherein the reconstructed voice signal is a super-wideband voice signal.

* * * * *